US008528759B2

(12) United States Patent
Pucci

(10) Patent No.: US 8,528,759 B2
(45) Date of Patent: Sep. 10, 2013

(54) CLOSURE MEANS

(75) Inventor: Fabrizio Pucci, Castel Guelfo di Bologna (IT)

(73) Assignee: Sacmi Cooperativa Meccanici Imola Societa' Cooperativa, Imola (BO) (IT)

( * ) Notice: Subject to any disclaimer, the term of this patent is extended or adjusted under 35 U.S.C. 154(b) by 1301 days.

(21) Appl. No.: 12/162,389

(22) PCT Filed: Jan. 17, 2007

(86) PCT No.: PCT/IB2007/000119

§ 371 (c)(1),
(2), (4) Date: Nov. 19, 2008

(87) PCT Pub. No.: WO2007/085927

PCT Pub. Date: Aug. 2, 2007

(65) Prior Publication Data

US 2009/0084751 A1 Apr. 2, 2009

(30) Foreign Application Priority Data

Jan. 27, 2006 (IT) ..... M02006A0027

(51) Int. Cl.
*B65D 41/34* (2006.01)

(52) U.S. Cl.
USPC ..... 215/253; 215/331; 220/266; 220/296

(58) Field of Classification Search
USPC ..... 215/331, 333, 200
IPC ..... B65D 41/34, 41/32, 41/38
See application file for complete search history.

(56) References Cited

U.S. PATENT DOCUMENTS

| | | | | | |
|---|---|---|---|---|---|
| 3,893,582 | A | * | 7/1975 | Kowalik | 215/221 |
| 3,980,195 | A | * | 9/1976 | Fillmore | 215/256 |
| 4,032,028 | A | * | 6/1977 | Reiss et al. | 215/217 |
| 4,526,282 | A | * | 7/1985 | Dutt et al. | 215/252 |
| 4,530,438 | A | * | 7/1985 | McDevitt | 215/252 |
| 4,540,098 | A | * | 9/1985 | Luker | 215/216 |
| 4,550,845 | A | * | 11/1985 | Guala | 215/252 |
| 4,674,643 | A | * | 6/1987 | Wilde et al. | 215/252 |
| 4,846,361 | A | * | 7/1989 | Haffner | 215/252 |

(Continued)

FOREIGN PATENT DOCUMENTS

| | | | |
|---|---|---|---|
| DE | 21 44 423 | | 3/1973 |
| EP | 561545 | A1 * | 9/1993 |

(Continued)

OTHER PUBLICATIONS

International Search Report for PCT/IB2007/000119, mailed Jul. 13, 2007.

(Continued)

*Primary Examiner* — Robert J Hicks
(74) *Attorney, Agent, or Firm* — Nixon & Vanderhye, P.C.

(57) ABSTRACT

A container comprises a neck provided with a thread arrangement on which a cap can be screwed as well as a contrast arrangement for interacting with an opening indicating device of the cap the contrast arrangement being provided along a helix arrangement of the thread arrangement; cap comprises a thread arrangement suitable for interacting with a further thread arrangement of a neck of a container, and an opening indicating device provided with a stop arrangement, the stop arrangement being provided along a helix arrangement of the thread arrangement.

32 Claims, 21 Drawing Sheets

(56) References Cited

U.S. PATENT DOCUMENTS

| | | | | | |
|---|---|---|---|---|---|
| 4,936,475 | A | * | 6/1990 | Montgomery | 215/252 |
| 5,020,682 | A | | 6/1991 | Dutt | |
| 5,040,692 | A | * | 8/1991 | Julian | 215/252 |
| 5,056,675 | A | * | 10/1991 | Julian | 215/252 |
| 5,145,080 | A | * | 9/1992 | Imbery, Jr. | 215/331 |
| 5,346,082 | A | * | 9/1994 | Ochs et al. | 215/252 |
| 5,462,186 | A | * | 10/1995 | Ladina et al. | 215/330 |
| 5,511,677 | A | | 4/1996 | Oder | |
| 5,533,633 | A | * | 7/1996 | King | 215/252 |
| 5,722,545 | A | * | 3/1998 | Rinne | 215/44 |
| 5,950,850 | A | * | 9/1999 | Takamatsu et al. | 215/252 |
| 5,992,657 | A | * | 11/1999 | Friedman | 215/209 |
| 6,123,212 | A | * | 9/2000 | Russell et al. | 215/330 |
| 6,415,935 | B1 | * | 7/2002 | Hins | 215/329 |
| 2005/0082249 | A1 | * | 4/2005 | King | 215/329 |
| 2005/0199572 | A1 | * | 9/2005 | Brozell | 215/218 |
| 2005/0252878 | A1 | | 11/2005 | Babcock | |
| 2005/0269282 | A1 | | 12/2005 | Luch | |
| 2007/0034595 | A1 | * | 2/2007 | Foster et al. | 215/330 |
| 2008/0257849 | A1 | * | 10/2008 | Farrar et al. | 215/222 |

FOREIGN PATENT DOCUMENTS

| | | |
|---|---|---|
| EP | 0 673 849 | 9/1995 |
| GB | 497 388 | 12/1938 |
| GB | 497388 | 12/1938 |
| GB | 1 360 949 | 7/1974 |
| GB | 31 44 924 | 5/1983 |
| GB | 2 251 240 | 7/1992 |
| GB | 2251240 | 7/1992 |
| GB | 2 358 626 | 8/2001 |
| JP | 64-9165 | 1/1989 |
| JP | S64-9165 | 1/1989 |
| JP | H8-113255 | 5/1996 |
| JP | 9-175549 | 7/1997 |
| JP | H9-175549 | 7/1997 |
| JP | 2000-335613 | 12/2000 |
| JP | 2001-335055 | 12/2001 |
| RU | 40627 U1 | 9/2004 |
| WO | 90/05681 | 5/1990 |
| WO | WO 03/059769 A1 | 7/2003 |

OTHER PUBLICATIONS

International Preliminary Report on Patentability for PCT/IB2007/000119, dated Mar. 11, 2008.

European Search Report for corresponding EP Appln No. 10154036, completed Mar. 4, 2010, 7 pages.

Russian Decision to Grant for corresponding RU Appln No. 2008134905, Jan. 11, 2010, 17 pages.

Notification of Reason for Refusal and English Translation for corresponding Japanese Application No. 2008-551896, mailed Mar. 13, 2012, 18 pages.

* cited by examiner

CLOSURE MEANS

CROSS-REFERENCE TO RELATED APPLICATIONS

This application is the U.S. national phase of International Application No. PCT/IB2007/000119, filed 17 Jan. 2007, which designated the U.S. The entire contents of that application is hereby incorporated by reference.

The invention relates to a closure arrangement comprising a container neck and a cap provided with an opening indicating device arranged to interact with said neck.

Containers are known that comprise a neck arranged for receiving a cap and provided with a mouth delimited by a lateral wall on which a threading is externally provided. An annular projection projects from the lateral wall, which annular projection extends circumferentially with respect to the neck and is arranged more distantly from an opening of the container with respect to the threading.

The cap is provided with a cylindrical skirt comprising a first portion which cooperates with a bottom wall in order to define a base body of the cap and a second portion comprising an opening indicating device suitable for informing a user of the integrity of a product packaged in the container. The opening indicating device is provided with a tamper-evident ring which interacts with the above-mentioned projection.

The first portion and the second portion are separated by an intended separation line constituted by a weakened zone, or a plurality of cuts, or openings, passing through the cylindrical skirt and spaced by bridge elements extending between the first portion and the second portion, the bridge elements being suitable to break during a first opening of the container.

A plurality of flaps emerge from an edge zone of the tamper-evident ring, which flaps, during use, are arranged internally of the cap and face towards the bottom wall.

When the container is opened for the first time, the flaps interact with the projection to prevent the detachment of the tamper-evident ring from the neck of the container and to promote the breakage of the bridge elements.

A drawback of known necks is that they have an axial dimension, i.e. a length, which is very large and therefore to manufacture these necks a considerable quantity of material is required, for example plastics.

A further drawback of known necks is that long forming cycles are required as the necks are formed from a considerable quantity of plastic material.

A further drawback is that in order to form the necks, complex and expensive moulds are required.

As the above-mentioned necks have a large height, the caps too which are to be associated with it have a relevant axial extension.

It follows that the manufacturing of the caps too requires the use of large quantities of plastic material and very long forming cycles.

Further, complex and expensive moulds are required for forming also the caps. An object of the invention is to improve the container necks.

A further object is to improve the caps which are associable to the necks of containers.

A further object is to obtain a container neck with which a cap provided with an opening indicating device can be associated, which cap has a limited height and which requires a modest quantity of plastic material for manufacture thereof.

A further object is to obtain a container neck which is simple to manufacture and which requires moderate forming times.

A still further object of the invention is to obtain a cap provided with an opening indicating device which cap has a contained axial extension and the manufacturing of which requires a modest quantity of plastic material.

A still further object of the invention is to obtain a cap which can be manufactured simply and with modest forming times.

In the present patent application, the term "helix arrangement" refers either to a threading (having one start only, or a plurality of starts) of a container neck, or of a cap associable to a container neck, and a helical path defined by the aforesaid threading in a case in which the thread has a single start, or a plurality of helical paths defined by the aforementioned threading in a case in which the threading has a plurality of starts.

In a first aspect of the invention, there is provided a container comprising a neck provided with a thread arrangement on which a cap is screwable, and a contrast arrangement suitable for interacting with an opening indicating device of said cap, wherein said contrast arrangement is provided along a helix arrangement of said thread arrangement.

In a second aspect of the invention, there is provided a cap comprising a thread arrangement suitable for interacting with a further thread arrangement of a neck of a container and an opening indicating device provided with a stop arrangement, wherein said stop arrangement is provided along a helix arrangement of said thread arrangement.

In a third aspect of the invention, there is provided a closure arrangement comprising a cap provided with an opening indicating device and a neck of a container provided with a thread arrangement, wherein there is provided a contrast arrangement arranged along a helix arrangement of said thread arrangement for interacting with said opening indicating device.

In a fourth aspect of the invention, there is provided a closure arrangement, comprising a cap provided with a thread arrangement and with an opening indicating device comprising a stop arrangement, said closure arrangement further comprising a neck of a container provided with a further thread arrangement, wherein said stop arrangement is provided along a helix arrangement of said thread arrangement and interact with an abutting arrangement projecting from said neck.

In a fifth aspect of the invention, there is provided use of a thread arrangement of a neck of a container with which a cap is associable, said cap being provided with an opening indicating device, as a contrast arrangement for promoting separation of said opening indicating device from a body of said cap along an intended separation line arrangement.

In a sixth aspect of the invention, there is provided use of a thread arrangement of a cap associable with a neck of a container and provided with an opening indicating device as a contrast arrangement for promoting separation of said opening indicating device from a body of said cap along an intended separation line arrangement.

Owing to these aspects of the invention a container can be obtained which are provided with a neck having a reduced height and being obtainable with forming cycles of short duration. It is further possible to produce a neck using a smaller quantity of plastic material than that required for obtaining known necks.

Owing to the invention it is further possible to obtain a cap provided with an opening indicating device having a limited axial dimension and being formed from a smaller quantity of plastic with respect to known caps.

The cap according to the invention can also be obtained simply and with very short forming cycles.

The invention can be better understood and implemented with reference to the enclosed drawings, which illustrate some embodiments thereof by way of non-limitative example, wherein.

Figure 1:
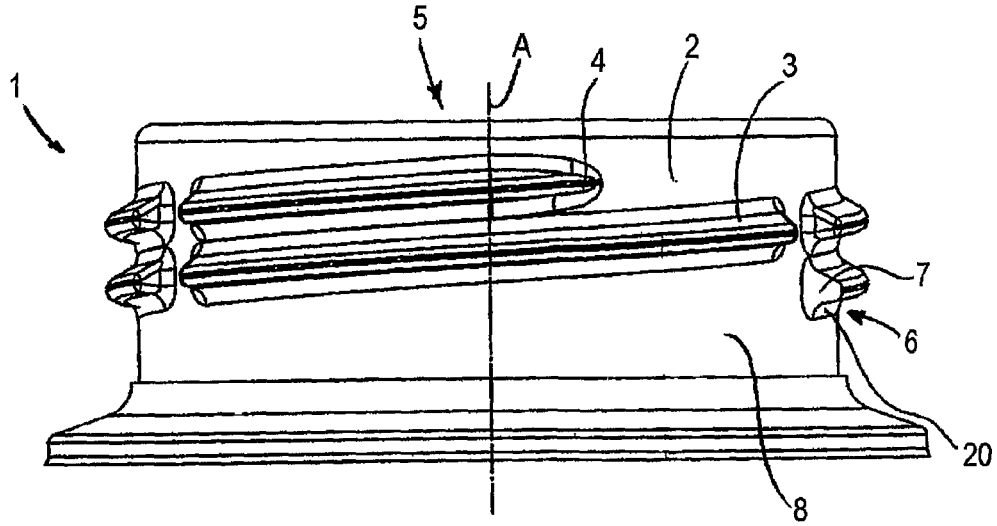
FIG. 1 is a side view of a neck.
Figure 2:
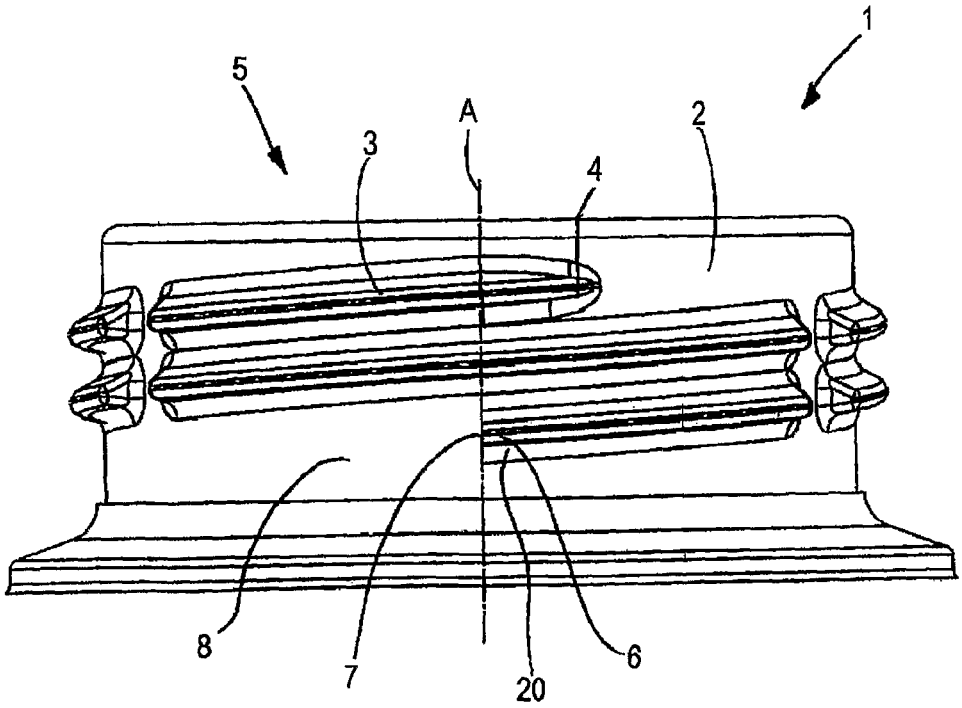
FIG. 2 is another side view of the neck of FIG. 1.

FIGS. 1 to 13 show a neck 1 of a container having a longitudinal axis A and comprising a mouth wall 2 from which a threading 3 transversally projects. The threading 3 comprises an initial portion 4, closer to an opening 5 of the container, and a final portion 6, more distant from the aforementioned opening 5. The initial portion 4 and the final portion 6 are arranged at opposite ends of the helical path defined by the threading 3. The final portion 6 comprises a first abutting surface 7, arranged transversally with respect to an external surface 8 of the mouth wall 2. In particular the first abutting surface 7 can lie on a plane passing through the longitudinal axis A and can be substantially perpendicular to the external surface 8, as shown in FIG. 2. Alternatively, the first abutting surface 7 can lie on an inclined plane with respect to the longitudinal axis A. In particular the first abutting surface 7 can be shaped in such a way as to define an inclined plane, or a cam profile which—when a cap body is unscrewed from the body 1—interacts with a flap arrangement or a hook arrangement, of a tamper-evident band of the cap, inducing the tamper-evident band to move away from the body. In this way, the body and the tamper-evident band move away from one another. This leads to a more immediate breaking of breakable bridge elements which connect the tamper-evident band to the body and offers greater evidence that the container has been opened.

The final portion 6 comprises a second abutting surface 20 arranged transversally with respect to the first abutting surface 7 and facing an opposite side of the opening 5. The second abutting surface 20 is obtained in a lower side of the threading 3.

Figure 3:
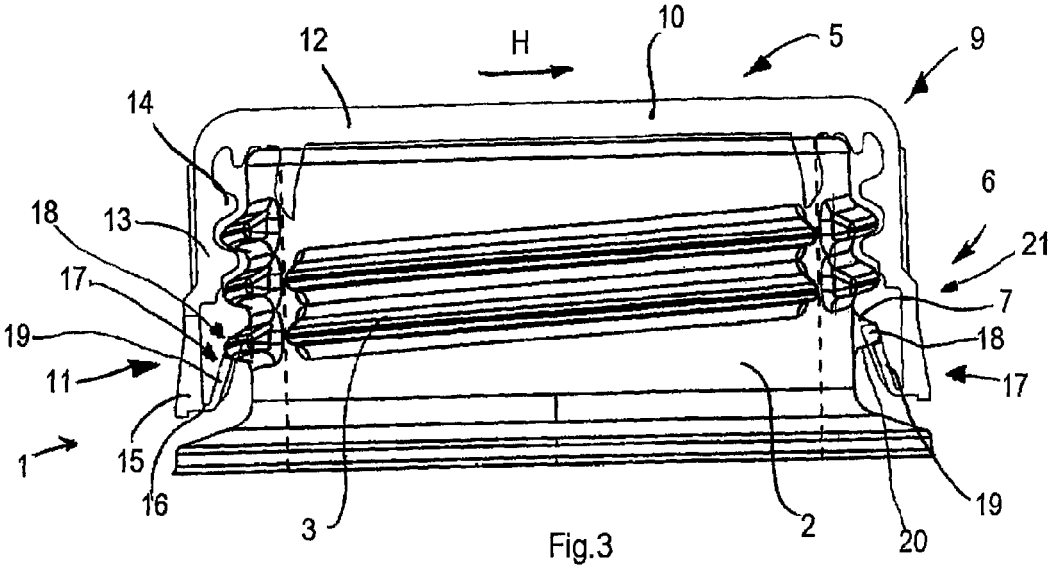
FIG. 3 is a partially-section side view which shows a first cap associated with the neck of FIG. 1.

FIG. 3 shows a cap 9, comprising a base body 10, provided with a bottom wall 12 from which a lateral wall 13 transversally projects. A further threading 14 is obtained internally of the cap 9, which threading 14 projects from the lateral wall 13 and is suitable for cooperating with the threading 3. The cap 9 is provided with a first opening indicating device 11 associated with a lower edge of the lateral wall 13 and provided with a tamper-evident ring 15. An intended separation line is interposed between the first opening indicating device 11 and the base body 10, which intended separation line is constituted by a plurality of cuts, or openings, between which bridge elements 21 are provided extending between the lateral wall 13 and the tamper-evident ring 15 and suitable to be fractured during the first opening of the container. A flap arrangement 17 is provided at a lower edge 16 of the tamper-evident ring 15, which a flap arrangement 17 interacts with the first abutting surface 7 and/or with the second abutting surface 20 in order to promote breakage of the bridge elements 21.

Figure 8:
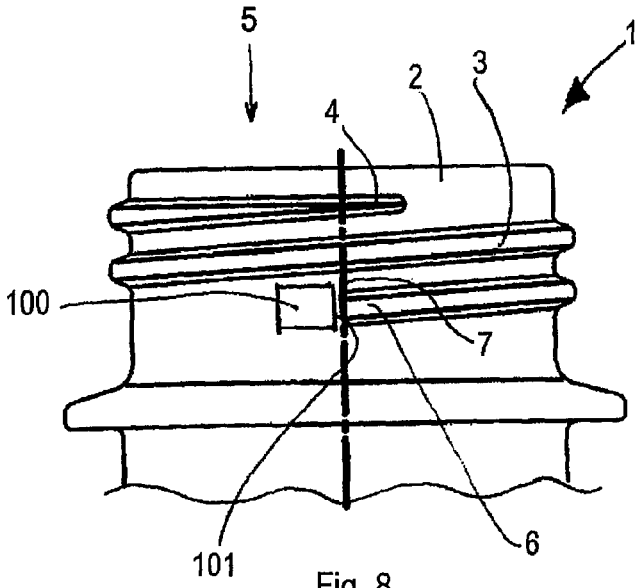
FIG. 8 is a side view schematically showing a neck cooperating with a first locking device of a cap.

As schematically shown in FIG. 8, the flap arrangement 17 can comprise a plurality of flap 100 provided with a face 101 arranged for interacting with the first abutting surface 7.

Figure 9:
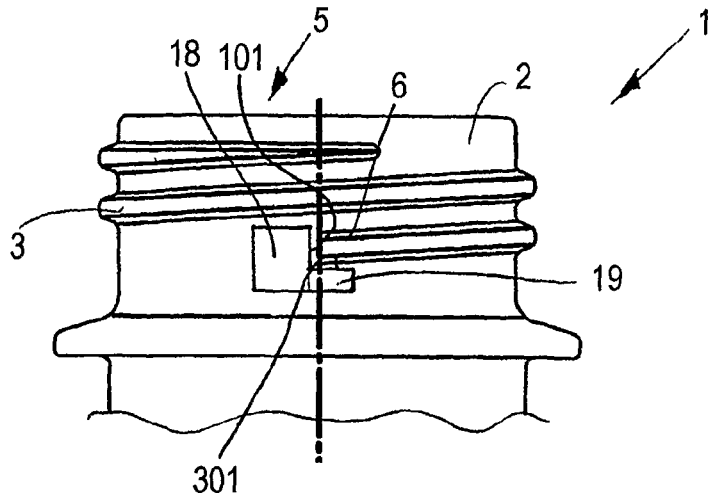
FIG. 9 is a view like the one in FIG. 8, schematically showing a neck cooperating with a second locking device of a cap.

Alternatively, as shown in FIGS. 3 and 9, the flap arrangement 17 can comprise first portions 18 and second portions 19 which are adjacent and arranged along a peripheral edge of the tamper-evident ring 15. The first portions 18 has a dimension, measured transversally to the lower edge 16, which is larger than a corresponding further dimension of the second portions 19, measured transversally to the lower edge 16.

In a non-shown version, the first portions 18 can be spaced away from the second portions 19, instead of being adjacent thereto.

When the container is opened for the first time, a face 101 of one of the first portions 18 interacts with the first abutting surface 7, while a further face 301 of one of the second portions 19 interacts with the second abutting surface 20, the first abutting surface 7 being arranged transversally with respect to an intended opening direction along which the cap 9 is unscrewed from the neck 1.

Figure 10:
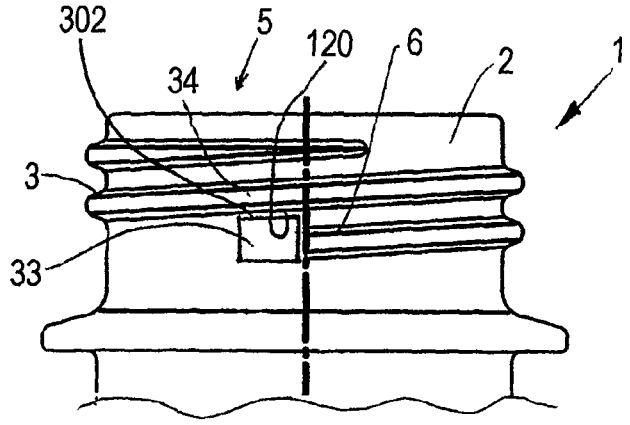
FIG. 10 is a view like the one in FIG. 8, schematically showing a neck cooperating with a third locking device of a cap.
Figure 11:
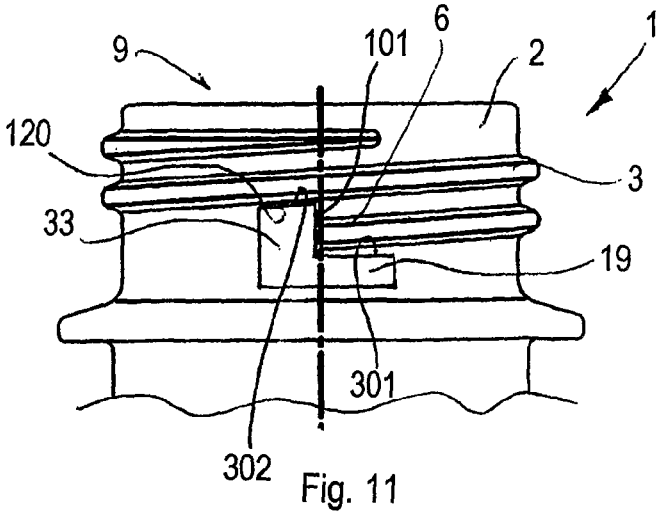
FIG. 11 is a view like the one in FIG. 8, schematically showing a neck cooperating with a fourth locking device of a cap.

A flap arrangement 17 can be provided, comprising further first portions 33 having a still further dimension measured transversally to the lower edge 16, which dimension is greater than the transversal dimension of the first portions 18, so as to be able to interact, at a still further face 302, with a zone 120—which defines a third abutting surface—of an intermediate portion 34 of the threading 3 arranged above the final portion 6, as schematically shown in FIGS. 10 and 11. In this way, interaction between the intermediate portion 34 and the further first portion 33 contributes to further locking the tamper-evident ring 15 in the axial direction, so as to ensure separation thereof from the base body 10 during a first opening of the container.

Similarly, the flaps 100 too can comprise a further face 301 and a still further face 302. The flap arrangement can comprise a continuous flap, i.e. a flap extending over all the lower edge 16.

Alternatively it is possible to provide that the flap arrangement 17 does not extend along all the lower edge, buy only along part thereof, in order for interrupted zones to be identified, i.e. zones not occupied by first portions 18 and/or by second portions 19. For example, the flap arrangement may comprise variable-height flap elements, each of which comprises at least a second portion 19 which precedes—or which, in a variant, is preceded by—a first portion 18, in a rotation direction along which the cap 9 is screwed onto the neck 1, the second portion 19 and the first portion 18 being reciprocally connected.

Alternatively, each flap element may comprise a first portion 18 and a pair of second portions 19, the first portion 18 being interposed between the second portions 19.

When the container is opened for the first time, the cap 9 is rotated in a rotation direction H in order to be unscrewed from the neck 1.

During the rotation, the first abutting surface 7 supportingly receives a first portion 18, thus preventing the tamper-evident ring 15 from rotating together with the base body 10. In this way, there is a relative rotation between the base body 10 and the first opening indicating device 11, this generating a shear stress on the bridge elements 21. Further, during the unscrewing of the cap 9, the base body 10 moves away from the final portion 6, moving parallel to the longitudinal axis A. The second abutting surface 20 prevents a second portion 19, and therefore the tamper-evident ring 15, from moving parallel to the longitudinal axis A. This generates a traction stress which, together with the shear stress aforementioned, rapidly and effectively fractures the bridge element 21, so that the tamper-evident ring 15 is separated from the lateral wall 13.

As described above, a cap may be associated with the neck 1, which cap has an opening indicating device provided with flaps 100 comprising only first portions 18 (as schematically shown in FIG. 8), or only further first portions 33 (as schematically shown in FIG. 10) and without second portions 19. In this case, during the first opening of the container a first portion 18, or a further first portion 33, interacts with the first abutting surface 7 and is locked so as not to rotate together with the base body 10. In this way, a shear stress is generated which fractures the bridge elements 21 and separates the first opening indicating device 11 from the base body 10.

Figure 4:
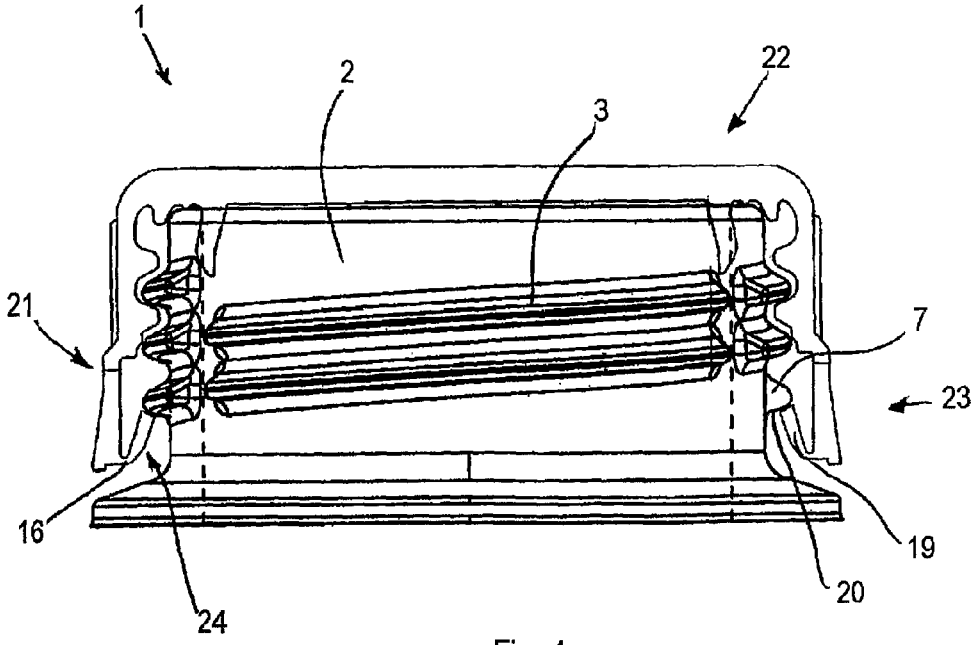
FIG. 4 is a view like the one in FIG. 3, showing a second cap associated with the neck of FIG. 1.

FIG. 4 shows the neck 1 cooperating with a further cap 22 conformed substantially similarly to the cap 9 and provided with a second opening indicating device 23. The second opening indicating device 23 differs from the first opening indicating device 11 inasmuch as it is provided with a further flap arrangement 24 devoid of the first portions 18 and comprising only second portions 19 which interact, during use, with the second abutting surface 20. In this case, during the first opening of the container, the second portions 19 are locked along a direction which is parallel to the longitudinal axis A. In this way a traction stress is generated which fractures the bridge elements 21 and separates the second opening indicating device 23 from the base body 10.

Figure 5:
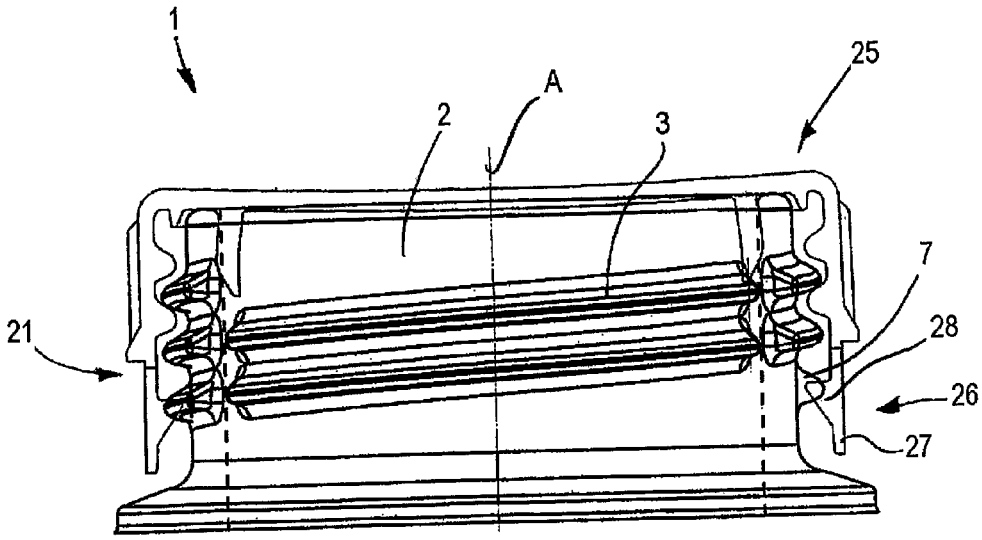
FIG. 5 is a view like the one in FIG. 3, showing a third cap associated with the neck of FIG. 1.

Alternatively, the further flap arrangement 24 may comprise a continuous flap. FIG. 5 shows the neck 1 to which a still further cap 25 is associated. The still further cap 25 is provided with a third opening indicating device comprising a further tamper-evident ring 27 from which hook portions 28 project circumferentially, the hook portions 28 facing towards the longitudinal axis A and being conformed in such a way as to cooperate with the first abutting surface 7. During a first opening of the container, the first abutting surface 7 interacts with a hook portion 28, preventing the tamper-evident ring 27 from rotating and fracturing the bridge elements 21, prevalently due to a cutting stress.

The hook portions 28 can be configured according to the versions shown in FIGS. 8, 9, 10 and 11.

Figure 6:
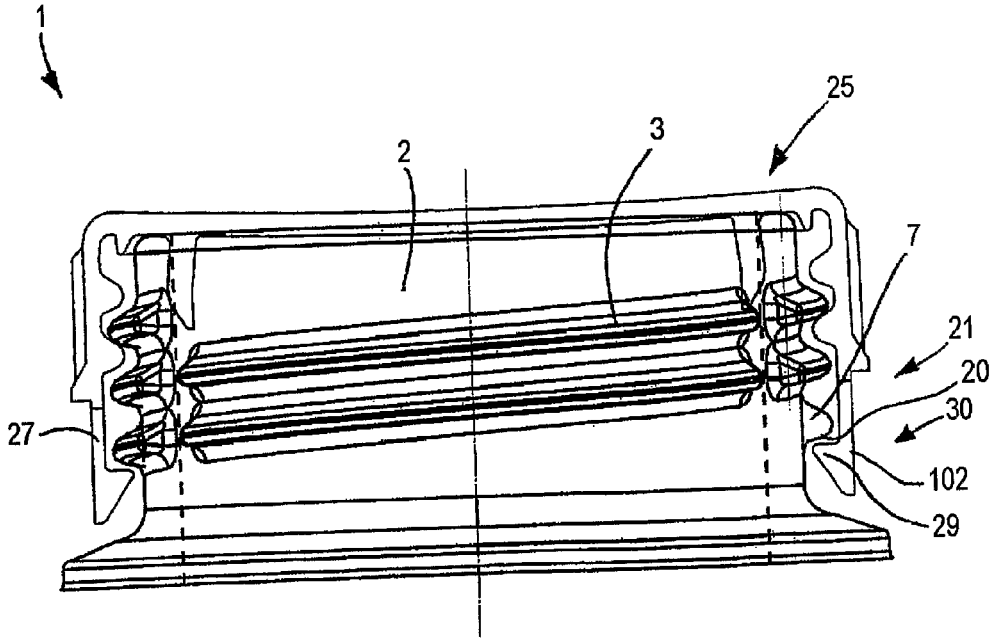
FIG. 6 is a view like the one in FIG. 3 showing a fourth cap associated to the neck of FIG. 1.

FIG. 6 illustrates a fourth opening indicating device 30 comprising a still further tamper-evident ring 102 from which further hook portions 29 project circumferentially, the further hook portions 29 being configured in such a way as to cooperate with the second abutting surface 20.

During a first opening of the container, the second abutting surface 20 interacts with a further hook portion 29 preventing the tamper-evident ring 27 from moving parallel to the longitudinal axis A while fracturing the bridge elements 21, prevalently due to a traction stress.

As shown in FIGS. 1 to 6, the neck 1 comprises a threading having a plurality of starts, and, therefore being provided with a plurality of initial portions and a plurality of final portions. The plurality of final portions acts to lock the first opening indicating device 11, in the case of the cap 9, the second opening indicating device 23, in the case of the further cap 22, the third opening indicating device 26 and the fourth opening indicating device 30 in the case of the still further cap 25, more effectively with respect to the case in which there is a single final portion. In particular, each final portion comprises a first abutting surface 7 which cooperates with a corresponding first portion 18, or with a corresponding hook portion 28.

Similarly, each final portion comprises a second abutting surface 20 which cooperates with a corresponding second portion 19, or with a corresponding further hook portion 29.

In this way, during the first opening of the container, the first opening indicating device 11, or the second opening indicating device 23, or the third opening indicating device 26, or the fourth opening indicating device 30 are contrasted at a plurality of peripheral zones and can be separated effectively and rapidly from the base body 10.

Figure 7:
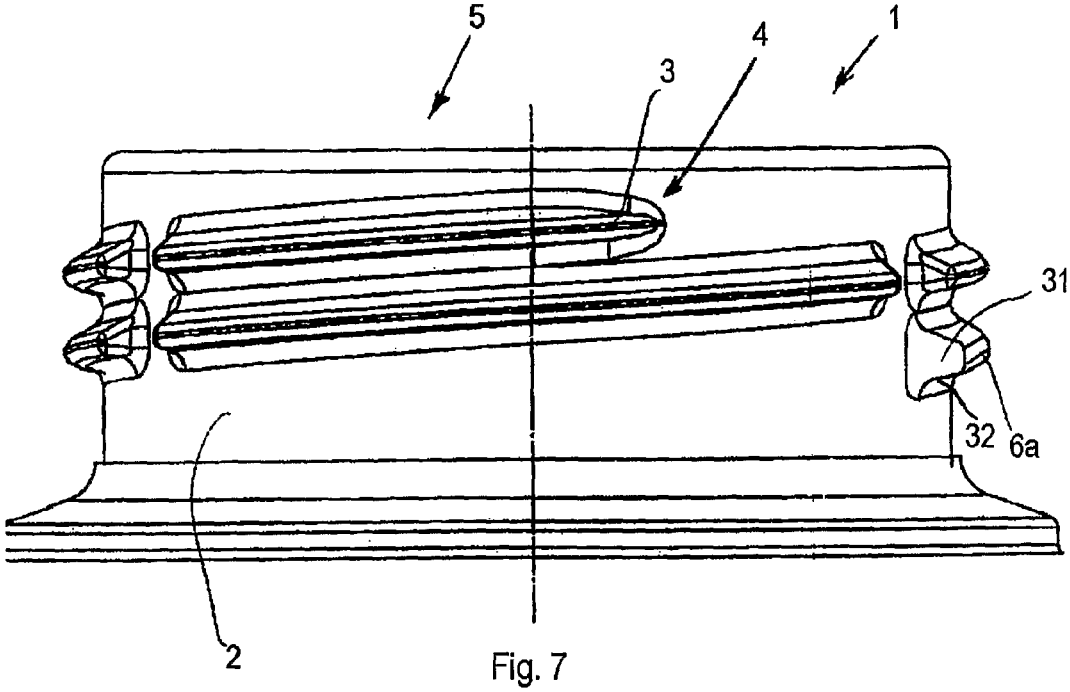
FIG. 7 is a side view of a further version of a neck.

FIG. 7 shows a version of the neck 1 in which the threading 3 comprises a transversal section an extension of which increases proceeding moving away from the opening 5. The threading 3 comprises a further final portion **6*a* having dimensions that are greater than the final portion 6 and which projects from the mouth wall 2 further with respect to the remaining part of the threading 3. The further final portion 6*a* comprises a further first abutting surface 31 larger that the first abutting surface 7 and a further second abutting surface 32 which is larger than the second abutting surface 20**, so as to render the contrast with an opening indicating device more effective.

In a further version, not shown, the neck 1 may comprise a threading having more than one start, therefore provided with a plurality of initial portions and a plurality of further final portions 6*a*, similarly to what is described herein above with reference to FIGS. 1 to 6.

With reference to FIGS. 27 to 30, the neck 1 comprises an abutting arrangement 70 arranged further from the opening 5 than the threading 3 and extending circumferentially from the neck 1. The abutting arrangement 70 is in addition, or are an alternative, to the first abutting surface 7 and to the second abutting surface 20, or to the further first abutting surface 31 and to the further second abutting surface 32.

The abutting arrangement 70 comprises at least a abutting element 71 provided with an active surface 72 arranged for interacting with an opening indicating device of a cap associated with the neck 1.

In particular, the active surface 72 is shaped in such a way as to generate shearing stress in the breakable bridge elements associated with the opening indicating device.

The active surface 72 is arranged transversally with respect to an intended opening direction along which the aforesaid cap is unscrewed from the neck 1.

Figure 27:
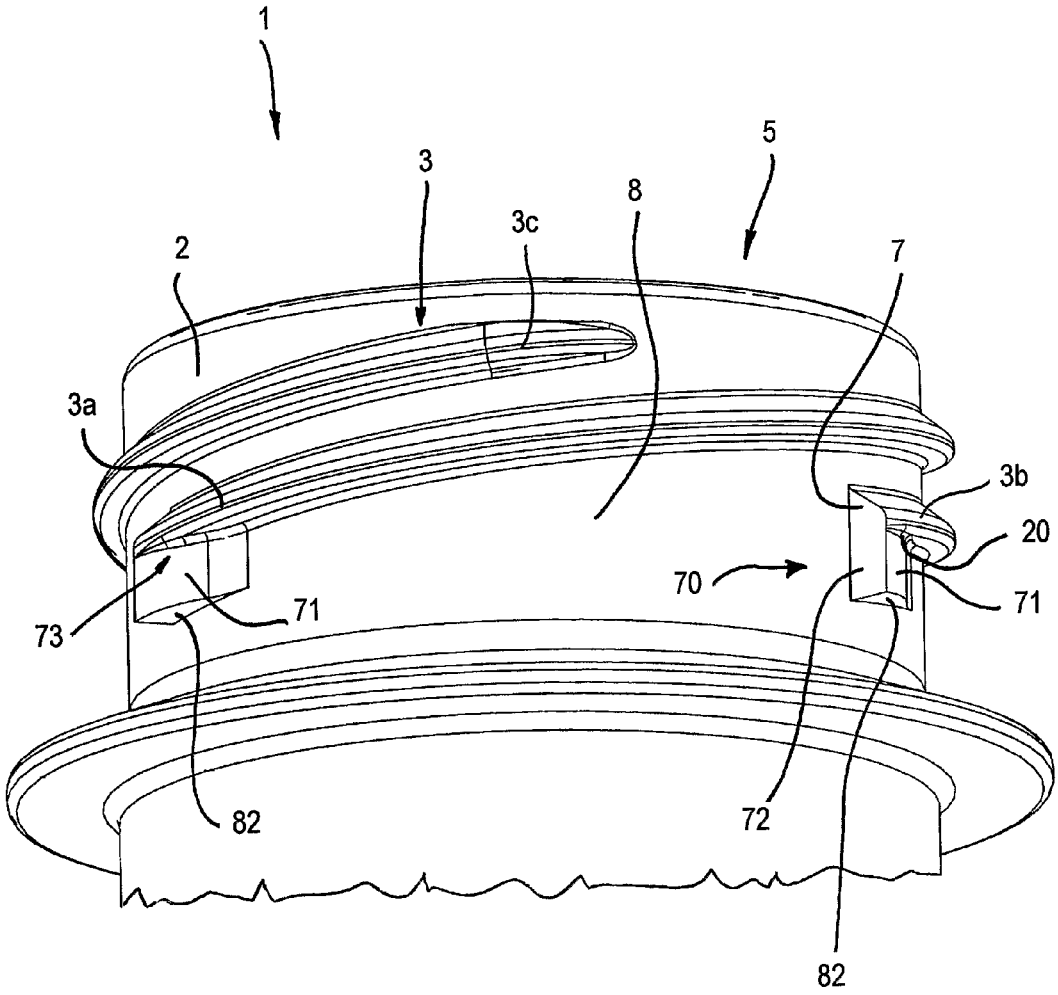
FIG. 27 is a perspective and fragmentary side view of the neck of FIG. 26.

The active surface 72 is arranged transversally with respect to the external surface 8 of the mouth wall 2. In particular, the active surface 72 can lie on a plane passing through the longitudinal axis A and being substantially perpendicular to the external surface 8, as shown in FIG. 27. Alternatively, the active surface 72 can lie on an inclined plane with respect to the longitudinal axis A.

In particular, the active surface 72 can be shaped in such a way as to define an inclined plane, or a cam profile which—when a body of the cap is unscrewed from the neck 1—interacts with a flap arrangement, or a hook arrangement, of the opening indicating device, inducing the opening indicating device to move away from the aforesaid body. In this way, the body and the opening indicating device move away from one another, moving in opposite directions. This leads to a more immediate breakage of the breakable bridge elements that connect the opening indicating device to the body and a greater evidence that opening of the container has occurred.

The abutting elements 71 can further comprise a further active face 82.

The further active face 82 is arranged for interacting with the aforesaid opening indicating device.

The further active face 82 is so shaped as to generate a further stress on the breakable bridge elements, in particular a traction stress, in addition—or alternatively—to the stress generated by the active surface 72.

The further active face 82 can be arranged substantially parallel to a plane defined by the opening 5.

The abutting arrangement 70 can comprise a number of abutting elements 71 which number is equal to the number of threads of the threading 3.

For example, the threading 3 may comprise three threads, i.e. a first thread 3*a*, a second thread 3*b* and a third thread 3*c*. In this case, the abutting arrangement 70 comprises a first abutting element 71*a*, associated to the first thread 3*a*, a second abutting element 71*b*, associated to the second thread 3*b* and a third abutting element (not illustrated in FIGS. 27 to 30), associated to the third thread 3*c*. Alternatively, the threading 3 may comprise a single thread and the abutting arrangement 70 may comprise a single abutting element 71.

Also alternatively, the threading 3 may comprise a different number of threads. The active surface 72 of the abutting element 71 and the first face 7 of a corresponding thread can be coplanar.

In a version, a flap—or a hook—of the opening indicating device interacts contemporaneously with the active surface 72 and with the first face 7. In this case, the active surface 72 exerts a contrasting action which adds to the action exerted by the first face 7.

In a further version, a flap—or a hook—of the opening indicating device interacts only with the active surface 72.

In a further version, which will be described in greater detail with reference to FIGS. 24 to 26, a portion of a threading of a cap, provided in the opening indicating device, interacts with the active surface 72 to promote the breakage of breakable bridge elements with which the cap is provided.

The abutting element 71 comprises a portion 73, closer to the opening 5, which is in contact with the threading 3. Alternatively, in a version which is not shown, between the portion 73 and the threading 3 there can be a gap, in which case the abutting element 71 is separated from the threading 3.

The abutting arrangement 70 can further comprise abutting bodies 74.

Figure 28:
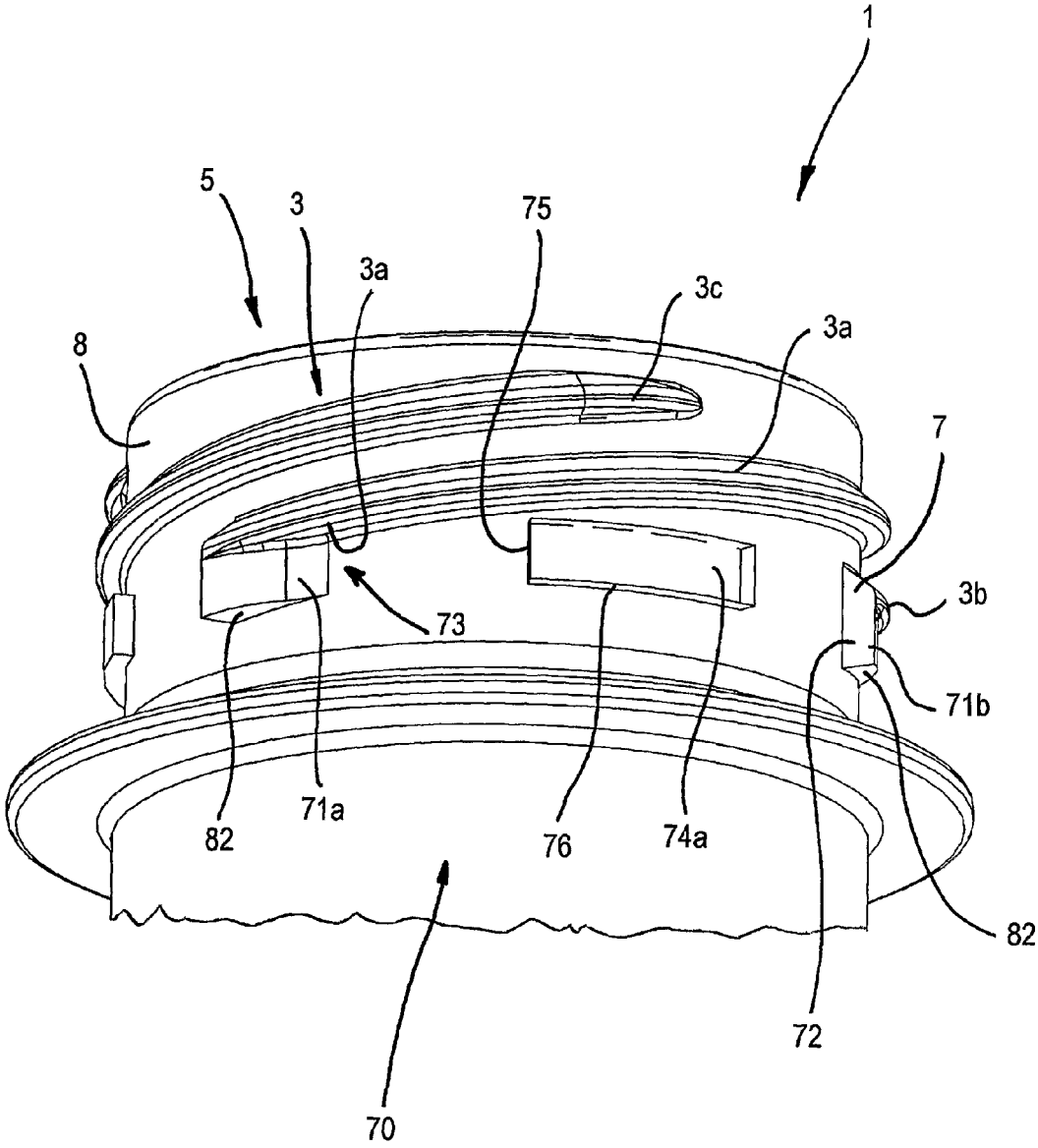
FIG. 28 is a view like the one in FIG. 27 showing a variant of the neck.

With reference to FIG. 28, a first version of a neck 1 is shown, in which the abutting arrangement 70 comprises a plurality of abutting bodies 74*a*.

In particular, the threading 3 comprises three threads and the abutting arrangement 70 comprises three abutting elements 71 and three abutting bodies 74*a* which are separated from the three abutting elements 71.

The abutting arrangement 70 is shaped in such a way that between two consecutive abutting elements 71 there is a abutting body 74*a* and that between two consecutive abutting bodies 74*a* there is a abutting element 71. In other words, the abutting elements 71 and the abutting bodies 74*a* are mutually alternated along a peripheral edge of the neck 1.

The abutting elements 71 and the abutting bodies 74*a* are arranged substantially on a same plane, which extends transversally (and, in particular, substantially perpendicular) to the longitudinal axis A.

The abutting bodies 74*a* comprise an active face 75. The active face 75 is so shaped as to interact with the above-mentioned opening indicating device.

In particular, the active face 75 is arranged such as to generate a shearing stress on the breakable bridge elements.

The active face 75 is arranged transversally of an intended opening direction along which the cap is unscrewed from the neck 1.

The active face 75 is arranged transversally of the external surface 8 of the mouth wall 2.

In particular, the active face 75 can lie on a plane passing through the longitudinal axis A and can be substantially perpendicular to the external surface 8, as shown in FIG. 28. Alternatively, the active face 75 can lie on an inclined plane with respect to the longitudinal axis A.

In particular, the active face 75 can be so shaped as to define an inclined plane, or a cam profile which—when a body of the cap is unscrewed from the neck 1—interacts with a flap arrangement, or a hook arrangement, of the opening indicating device, inducing the opening indicating device to move away from the body. In this way, the body and the opening indicating device move away from one another, moving in opposite directions. This leads to a more immediate fracturing of the breakable bridge elements connecting the opening indicating device to the body, as well as clearer evidence that the container has in fact been opened.

The abutting bodies 74*a* may further comprise a further active face 76.

The further active face 76 is predisposed to interact with the aforesaid opening indicating device.

In particular, the first active face 76 is so shaped as to interact, for example with the described ways with reference to FIGS. 1 to 11, with flap elements—or with hook elements—of the opening indicating device in order to generate a traction stress on the breakable bridge elements.

The further active face 76 can be arranged substantially parallel to a plane defined by the opening 5.

Figure 29:
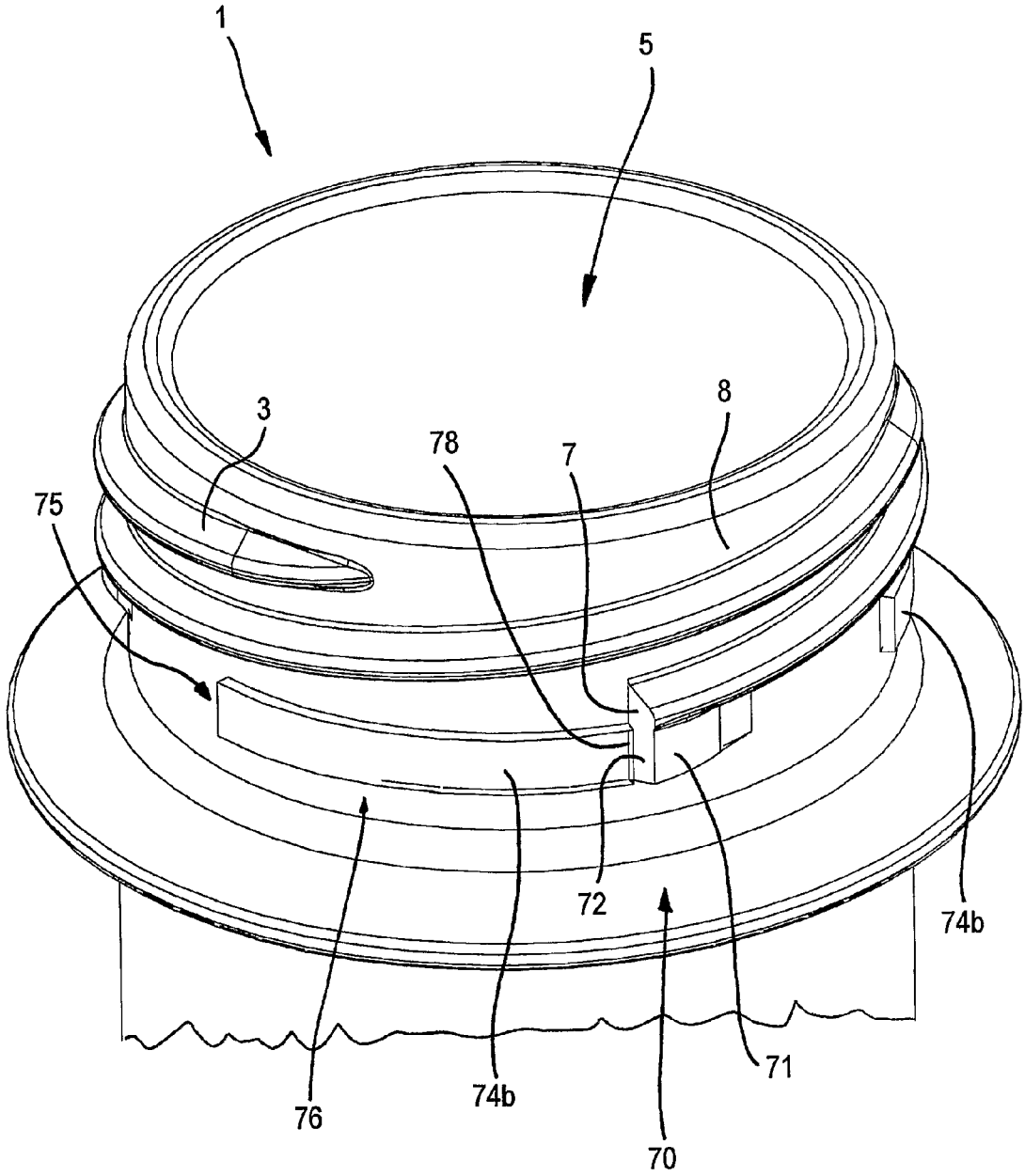
FIG. 29 is a view like the one in FIG. 27 showing a further variant of the neck.

With reference to FIG. 29, a second version of a neck 1 is shown, in which the abutting arrangement 70 comprises a plurality of abutting bodies 74*b*.

The second version substantially corresponds to the first version described with reference to FIG. 28 and differs therefrom in that the abutting bodies 74*b* are not separated from the abutting elements 71.

Each abutting element 74*b* comprises an end portion 78 which is connected to a corresponding abutting element 71.

In particular, the end portion 78 extends from the active surface 72.

Figure 30:
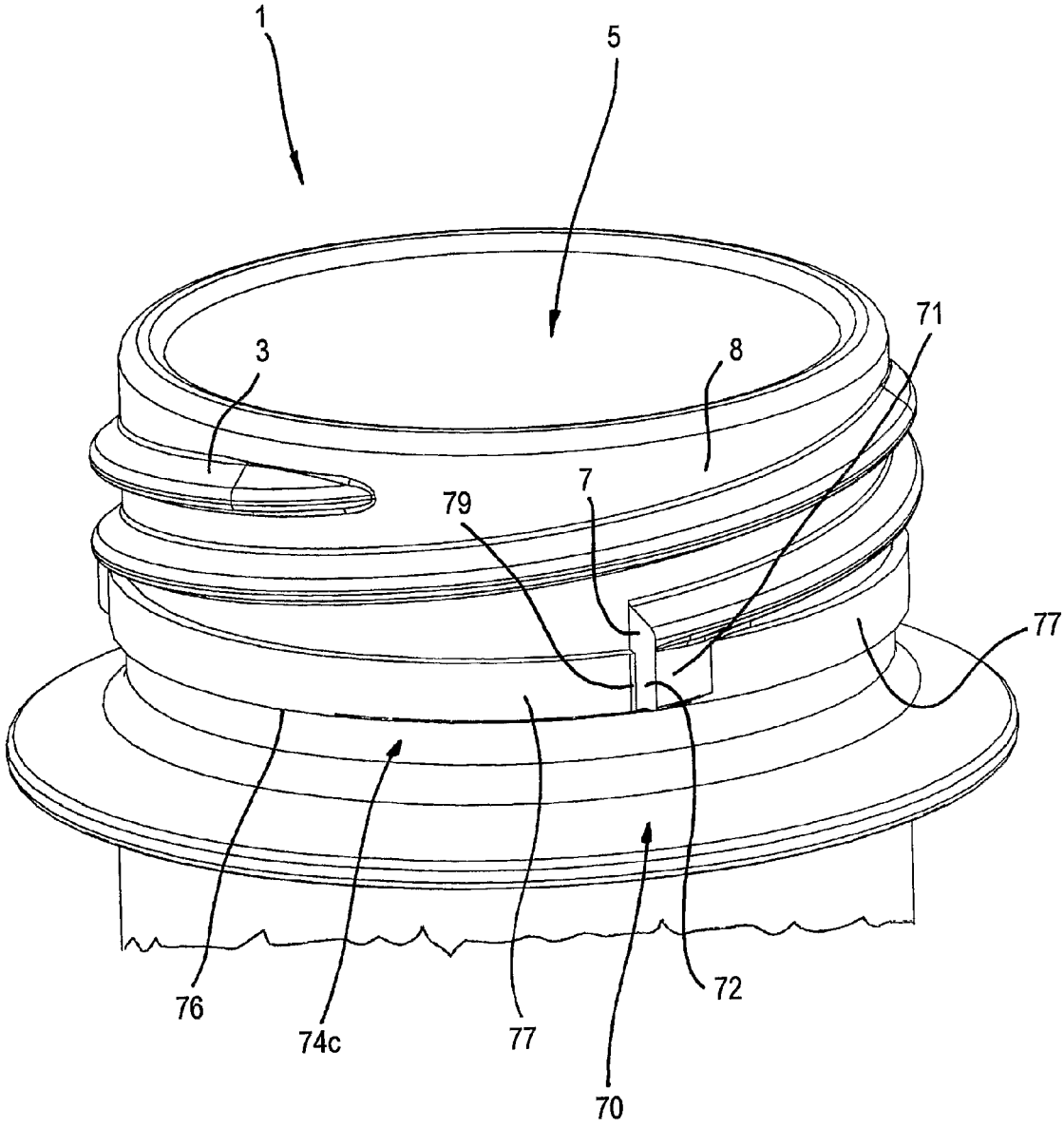
FIG. 30 is a view like the one in FIG. 27 showing a further variant of the neck.

With reference to FIG. 30, a third version of a neck 1 is shown, in which an abutting arrangement 70 comprises a abutting body 74*c*.

The third version substantially corresponds to the second version described with reference to FIG. 29 and differs therefrom in that instead of a plurality of abutting bodies 74*b* a single abutting body 74*c* is included, which is ring-shaped and extending from the external surface 8 as a projection.

The abutting body 74*c* comprises three abutting portions 77, each of which is interposed between a pair of adjacent abutting elements 71.

Each abutting portion 77 comprises a further end portion 79 which is connected to a corresponding abutting element 71.

In particular, the further end portion 79 extends from the active surface 72.

The abutting body 74*c* is provided with the further active face 76, but not with the active face 75.

With reference to the versions of FIGS. 28 to 30, a flap—or a hook—of the opening indicating device can interact with the active face 75 and/or with the further active face 76, while a further flap—or hook—of the opening indicating device interacts with the active surface 72 and/or the first face 7. In this case, the active face 75 and/or the further active face 76 performs a contrasting action which is added to the action exerted by the active surface 72 and/or the first face 7.

The abutting bodies 74 can serve as reference elements and/or abutting elements and/or guide elements for the transport of containers or container preforms, since the abutting bodies 74 comprise significantly large surfaces—especially the further active surfaces 82—at which transporter devices can interact with the containers or the preforms.

In particular, thanks to the abutting bodies 74, the containers or preforms can be transported more effectively than in a case where the neck comprises only the abutting elements 71.

Figure 21:
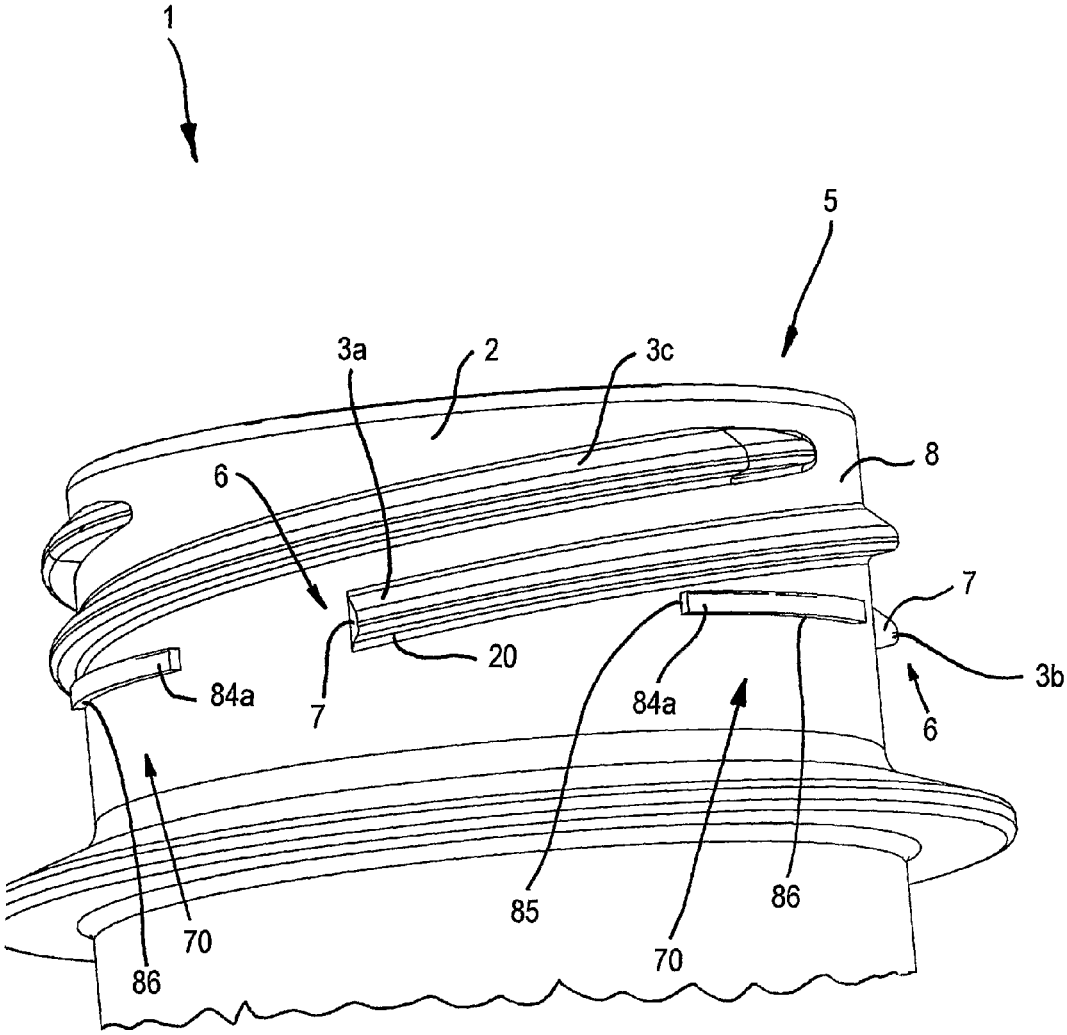
FIG. 21 is a perspective and fragmentary side view of a neck.
Figure 22:
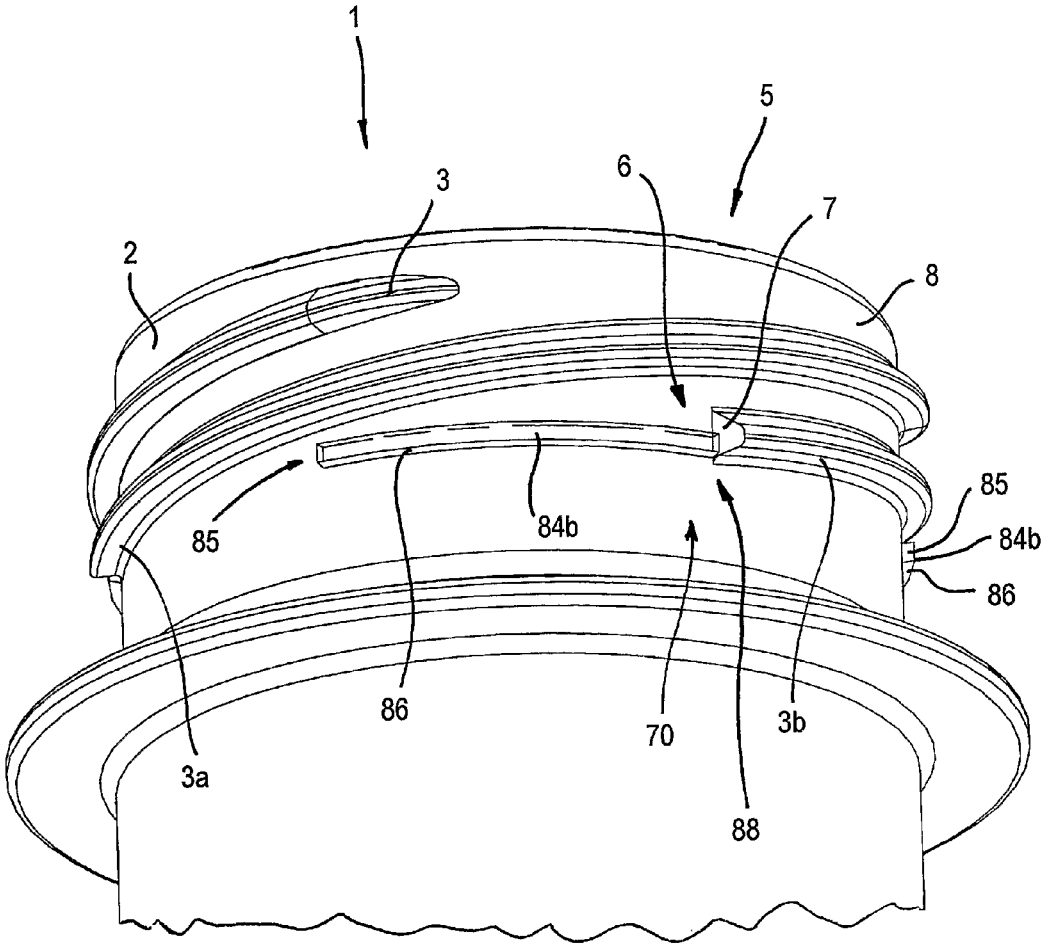
FIG. 22 is a view like the one in FIG. 21, showing a variant of the neck.
Figure 23:
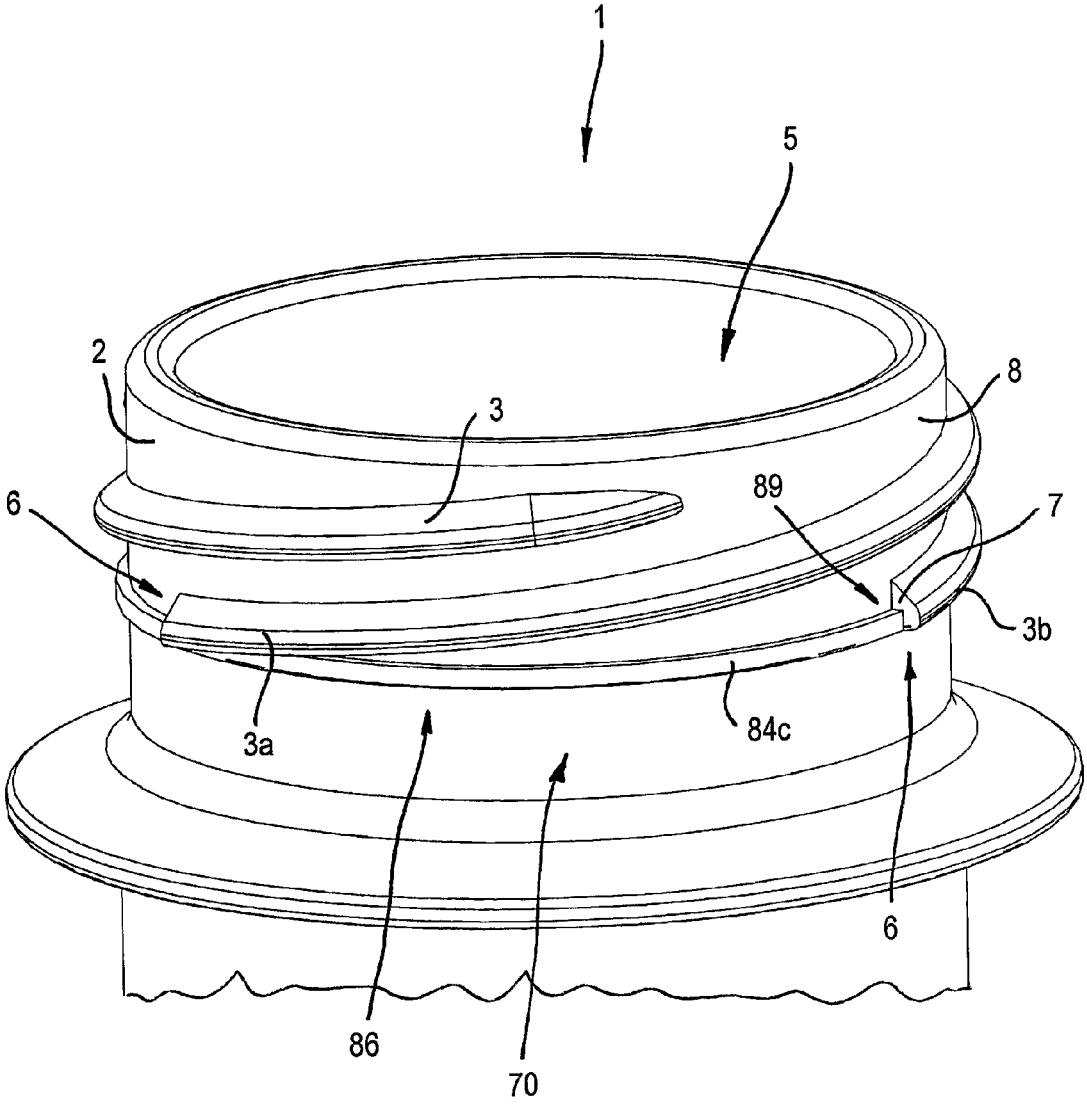
FIG. 23 is a further view like the one in FIG. 21, showing a further variant of the neck.

With reference to FIGS. 21 to 23, the neck 1 comprises an abutting arrangement 70.

The abutting arrangement 70 and the final portions 6—or the further final portions 6*a*—are arranged substantially on a same plane, extending transversally (and, in particular, substantially perpendicular) to the longitudinal axis A.

In a version, the abutting arrangement 70 and the final portions 6 are mutually alternated so that each final portion 6 is interposed between two consecutive abutting arrangements.

The abutting arrangement exerts a contrasting action on an opening indicating device associated with the neck; this contrasting action is added to the action of the first surfaces 7 and/or the second surfaces 20, enabling a simpler and more immediate fracturing of the bridge elements 21.

The abutting arrangement 70 comprises at least an abutting body 84 arranged for interacting with an opening indicating device associated with the neck 1.

The abutting arrangement 70 may comprise a number of abutting bodies 84 which is equal to the number of threads of the threading 3.

For example, the threading 3 can comprise three threads, that is, a first thread 3*a*, a second thread 3*b* and a third thread 3*c*, and the abutting arrangement 70 can comprise a first abutting body, a second abutting body and a third abutting body.

Alternatively, the threading 3 can comprise a single thread and the abutting arrangement 70 can comprise a single abutting body.

Also alternatively, the threading 3 can comprise a different number of threads.

The abutting arrangement 70 comprises abutting bodies 84 conformed substantially in the same way as the abutting bodies 74 described with reference to FIGS. 27 to 30.

With reference to FIG. 21, a first version of a neck 1 is shown, in which the abutting arrangement 70 comprises a plurality of abutting bodies 84*a*.

In particular, the threading 3 comprises three threads, each provided with respective final portion 6, and the abutting arrangement 70 comprises three abutting bodies 84*a* separated from the three threads.

The abutting arrangement 70 is so shaped that between two consecutive final portions a abutting body 84*a* is interposed, and between two consecutive abutting bodies 84*a* a final portion 6 is interposed. In other words, the final portions 6 and the abutting bodies 84*a* are mutually alternated along a peripheral edge of the neck 1.

The final portions 6 and the abutting bodies 84*a* are arranged substantially on a same plane which extends transversally (and, in particular, substantially perpendicular) to the longitudinal axis A.

The abutting bodies 84*a* comprise an active face 85.

The active face 85 is so shaped as to interact with an opening indicating device associated to the neck 1.

In particular, the active face 85 is arranged for generating a shearing force on breakable bridge elements of the opening indicating device.

The active face 85 is arranged transversally to an intended opening direction, along which the cap is unscrewed from the neck 1.

The active face 85 is arranged transversally to the external surface 8 of the mouth wall 2.

In particular, the active face 85 can lie on a plane passing through the longitudinal axis A and can be substantially perpendicular to the external surface 8, as shown in FIG. 21. Alternatively, the active face 85 can lie on an inclined plane with respect to the longitudinal axis A.

In particular, the active face 85 can be so shaped as to define an inclined plane, or a cam profile which—when a body of the cap is unscrewed from the neck 1—interacts with a flap arrangement, or a hook arrangement, of the opening indicating device, inducing the opening indicating device to move away from the body. In this way, the body and the opening indicating device move away from one another, moving in opposite directions. This leads to a more immediate fracturing of the breakable bridge elements which connect the opening indicating device to the body and a clearer evidence that the container has been opened.

The abutting bodies 84*a* can further comprise a further active face 86.

The further active face 86 is arranged for interacting with the opening indicating device.

In particular, the further active face 86 is so shaped as to interact, for example following the ways described with reference to FIGS. 1 to 11, with a flap arrangement—or a hook arrangement—of the opening indicating device, in order to generate a traction stress on the breakable bridge elements.

The further active face 86 can be arranged substantially parallel to a plane defined by the opening 5.

With reference to FIG. 22, a second version of a neck 1 is shown in which the abutting arrangement 70 comprises a plurality of abutting bodies 84*b*.

The second version substantially corresponds to the first version described with reference to FIG. 22 and differs therefrom in that the abutting bodies 84*b* are not separated from the final portions 6 of the threads.

Each abutting element 84*b*, in fact, comprises an end portion 88 which is connected to a corresponding final portion 6.

In particular, the end portion 88 extends from the first face 7.

With reference to FIG. 23, a third version is shown of a neck 1 in which an abutting arrangement 70 comprises an abutting body 84*c*.

The third version substantially corresponds to the second version described with reference to FIG. 22 and differs therefrom due to the fact that instead of a plurality of abutting bodies 84*b* a single abutting body 84*c* is included, ring-shaped and extending from the external surface 8 as a projection.

The abutting body 84*c* comprises three abutting portions 87, each of which is interposed between a pair of adjacent final portions 6.

Each abutting portion 87 comprises a further end portion 89 which is connected to a corresponding final portion 6.

In particular, the further portion 89 extends from the first face 7.

The abutting body 84*c* is provided with the further active face 86, but not the active face 85.

A flap—or a hook—of the opening indicating device can interact with the active face 85 and/or the further active face 86, while a further flap—or further hook—of the opening indicating device interacts with the first face 7 and/or the second face 20. In this case, the active face 85 and/or the further active face 86 exert a contrasting action which is added to the action exerted by the first surface 7 and/or the second face 20.

The abutting bodies 84 can serve as reference elements and/or as abutting elements and/or as guide elements for the transport of containers or container preforms, as the abutting bodies comprise surfaces of a significant size—especially the further active faces 86—at which transfer devices can interact with the containers or preforms.

In a non-shown version, a recess can be obtained in the mouth wall 2—extending over a portion of the thickness of mouth wall 2—a surface of which constitutes a part of the second abutting surface 20, or of the further second abutting surface 32, in such a way as further to increase the size of the second abutting surface 20, or of the further second abutting surface 32.

Similarly, a further recess can be obtained in the mouth wall 2—extending over a portion of the thickness of the mouth wall 2—a surface of which constitutes a part of the first abutting surface 7, or of the further first abutting surface 31, in such a way as further to increase the size of the first abutting surface 7, or of the further first abutting surface 31.

Figure 12:
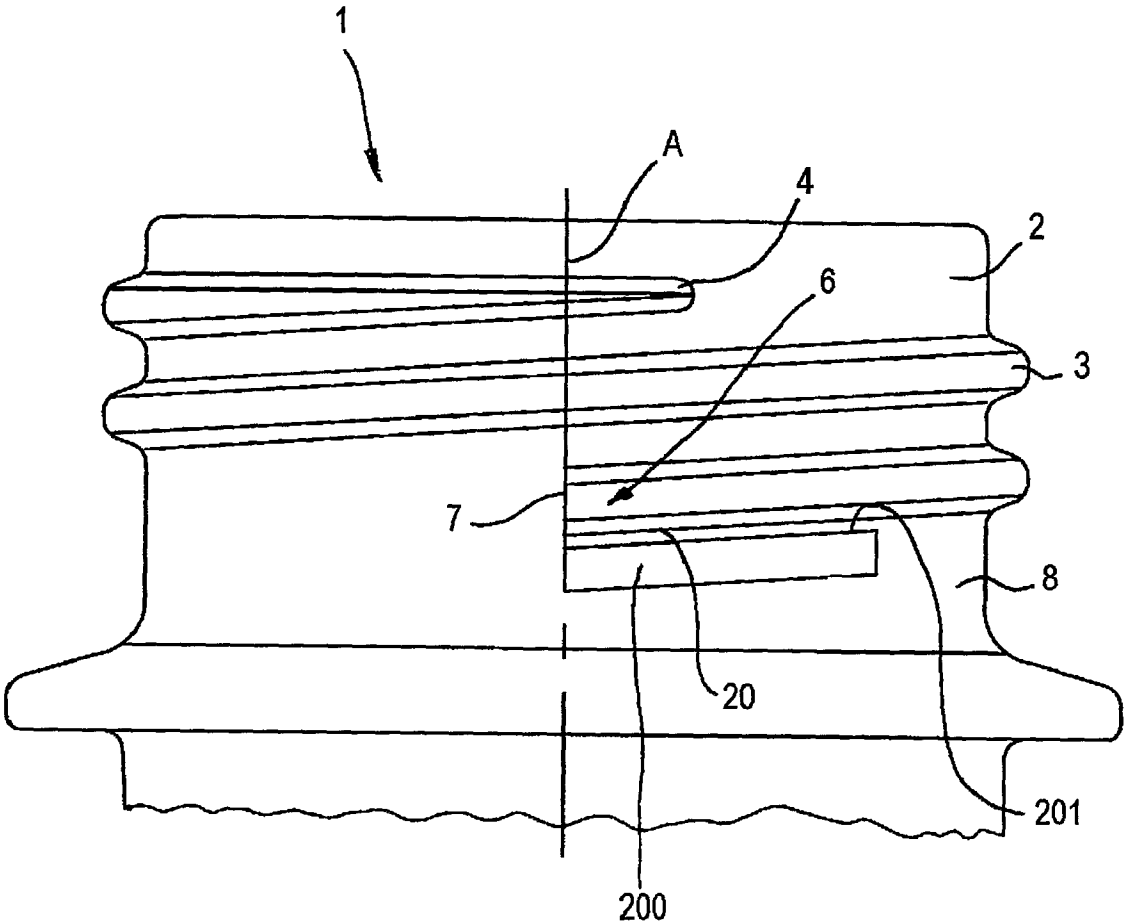
FIG. 12 is a view like the one in FIG. 8, schematically showing a neck cooperating with a fifth locking device of a cap.

FIG. 12 shows a projecting element 200 of a tamper-evident ring (which may comprise, for example, a flap, or a hook, shaped as shown with reference to FIGS. 3 to 11), which is provided with a face 201 arranged substantially parallel to the threading 3.

In particular the face 201 is substantially parallel to the second abutting surface 20 with which it interacts when the cap is removed for the first time from the neck 1.

Figure 13:
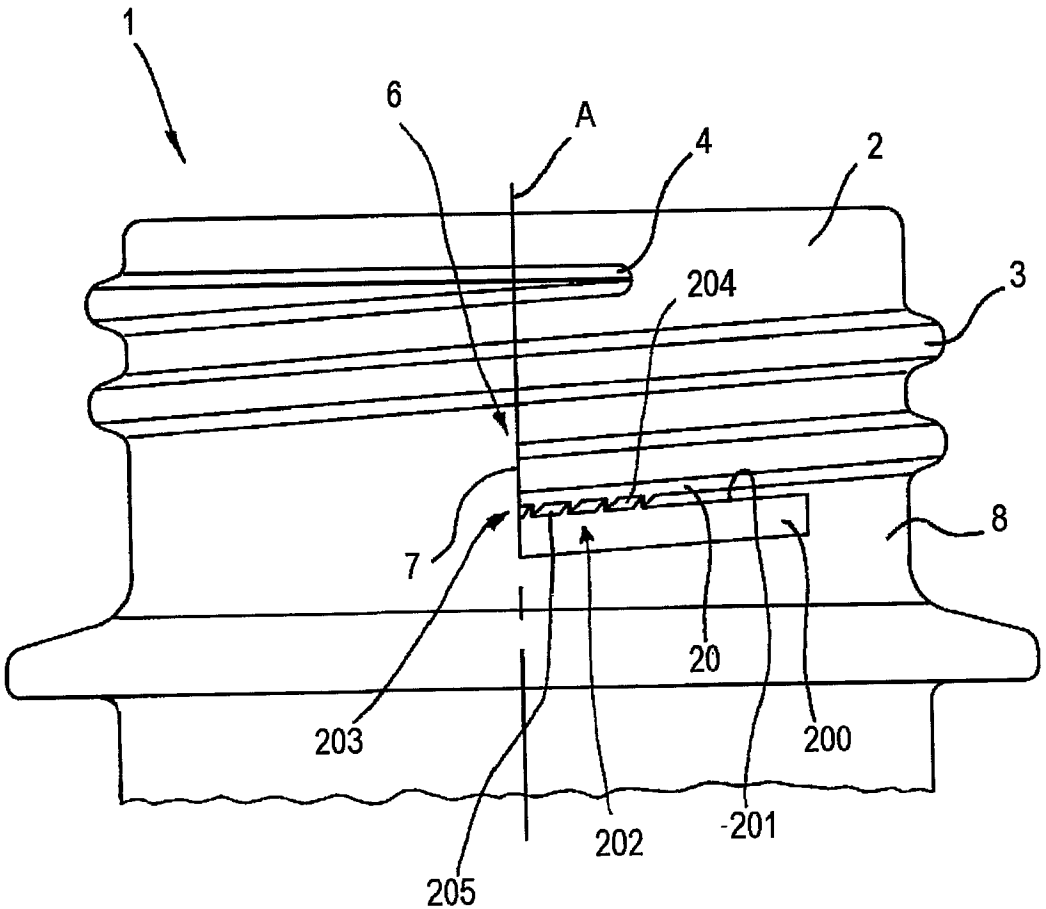
FIG. 13 is a view like the one in FIG. 8, schematically showing a neck cooperating with a sixth locking device of a cap.

Similarly, the further face 301 and the still further face 302, described with reference to FIGS. 9 to 11, can be arranged substantially parallel to the second abutting surface 20 and the third abutting surface 120 respectively. With reference to FIG. 13, a variant of the projecting element 200 is shown, in which the face 201 is provided with a gripping promoting arrangement 202 arranged for cooperating with a further gripping promoting arrangement 203 with which the second abutting surface 20 is provided.

The gripping promoting arrangement 202 may comprise a corrugated zone, or a toothed zone 204.

Similarly the further gripping promoting arrangement 203 may comprise a further corrugated zone, or a further toothed zone 205, conformed in such a way as to engage with the corrugated or toothed zone 204.

Also the further face 301 and the still further face 302, described with reference to FIGS. 9 to 11, may comprise a gripping promoting arrangement.

Figures from 14 to 18 show a cap 35 comprising a further bottom wall 36 from which a cylindrical skirt 37 transversally projects. A thread arrangement 30 projects from the cylindrical skirt 37 internally of the cap 35 and comprises interrupted zones 52. During packing of a product in the container, the interrupted zones 52 enable evacuation through the thread arrangement 38 of any portion of product which has been accidentally deposited externally of the container, or which may have exited therefrom.

The interrupted zones 52 also facilitate evacuation of any gas dissolved in the product during a first opening of the container.

The thread arrangement 38 comprises an opening indicating device 39 which serves to inform a user regarding any previous opening of the bottle with which the cap 35 is associated.

The opening indicating device 39 comprises a stop arrangement 600 provided with a locking portion 40 obtained on a thread end portion 43 of the thread arrangement 38 further from the further bottom wall 36. In particular, the locking portion 40 is arranged in proximity of an end zone 41 of the thread end portion 43 and at a certain distance from an end edge 42 of the cap 35.

The locking portion 40 extends towards the further bottom wall 36 in such a way as to project transversally with respect to the thread end portion 43 by a smaller amount than a step of the thread arrangement 38.

The locking portion 40, then, extends towards a thread intermediate portion 46 of the thread arrangement 38 closest to the further bottom wall 36 with respect to the thread end portion 43.

Figure 14:
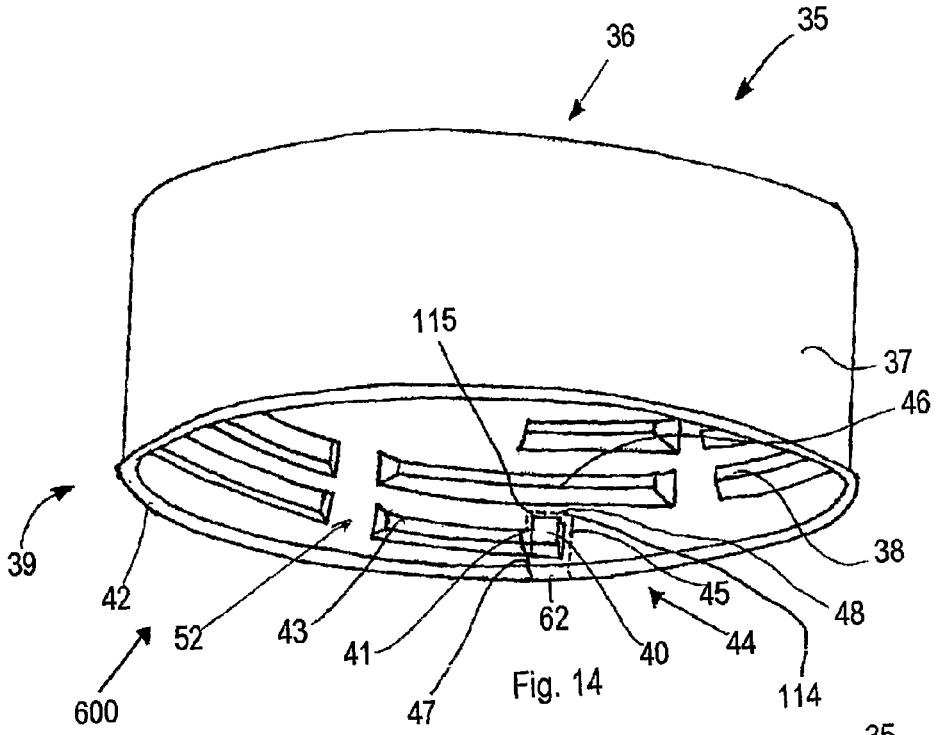
FIG. 14 is a perspective view of a first version of a cap.

FIG. 14 shows a first version of an opening indicating device 39 comprising a first intended separation line arrangement 44 which defines a first removable portion 62 destined to be separated from the cylindrical skirt 37 during a first opening of the container.

The first intended separation line arrangement 44 surrounds the locking portion 40 and comprise a plurality of incisions, or cuts, passing through the cylindrical skirt 37.

Alternatively, the first intended separation line arrangement 44 may comprise, instead of the incisions, or cuts, a weakening line along which the cylindrical skirt 37 exhibits a narrowed thickness.

The first intended separation line arrangement 44 comprises a first intended separation line 45 arranged transversally with respect to the thread end portion 34 and also arranged opposite the end zone 41 with respect to the locking portion 40. The first intended separation line 45 extends from a zone of the end edge 42 to a further zone comprised between the locking portion 40 and the thread intermediate portion 46.

The first intended separation line arrangement 44 further comprises a second intended separation line 47 arranged substantially parallel to the first intended separation line 45 and on an opposite side thereto with respect to the locking portion 40. The second intended separation line 47 is close to the locking portion 40 and extends in such a way as to cross the thread end portion 43.

Figure 15:
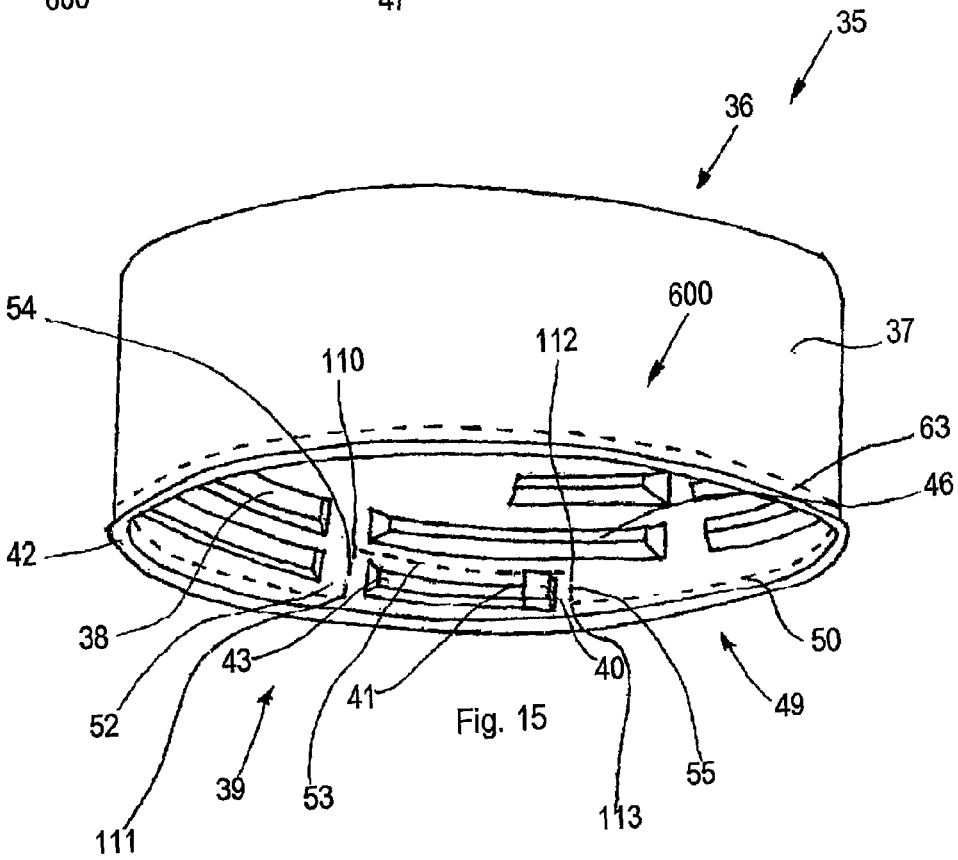
FIG. 15 is a perspective view of a second version of a cap.

Between the thread intermediate portion 46 and the locking portion 40 is a third intended separation line 48, which connects an end 114 of the first intended separation line 45 to a further end 115 of the second intended separation line 47. FIG. 15 shows a second version of the opening indicating device 39 comprising a second intended separation line arrangement 49 which defines a second removable portion 63 destined to be separated from the cylindrical skirt 37 during a first opening of the container. The second intended separation line arrangement 49 comprises a fourth intended separation line 50 which extends substantially parallel to the end edge 42 and which is arranged further from the further bottom wall 36 than the thread arrangement 38.

The fourth intended separation line 50 is interrupted at the thread end portion 43. The second intended separation line arrangement 49 further comprises a fifth intended separation line 53 which is substantially parallel to the lower edge 42 and is arranged between the thread intermediate portion 46 and the thread end portion 43. The fifth intended separation line 53 is circumferentially larger than the thread end portion and extends bilaterally therefrom. In the interrupted zone 52 there is provided a sixth intended separation line 54 which extends transversally to the lower edge 42 in such a way as to connect a first end 110 of the fifth intended separation line 53 with a further first end 111 of the fourth intended separation line 50. In a region of the cylindrical skirt 37 opposite the interrupted zone 52 with respect to the locking portion 40, a seventh intended separation line 55 extends transversally to the lower edge 42 in such a way that it connects a second end 112 of the fifth intended separation line 53 with a further second end 113 of the fourth intended separation line 50.

Figure 16:
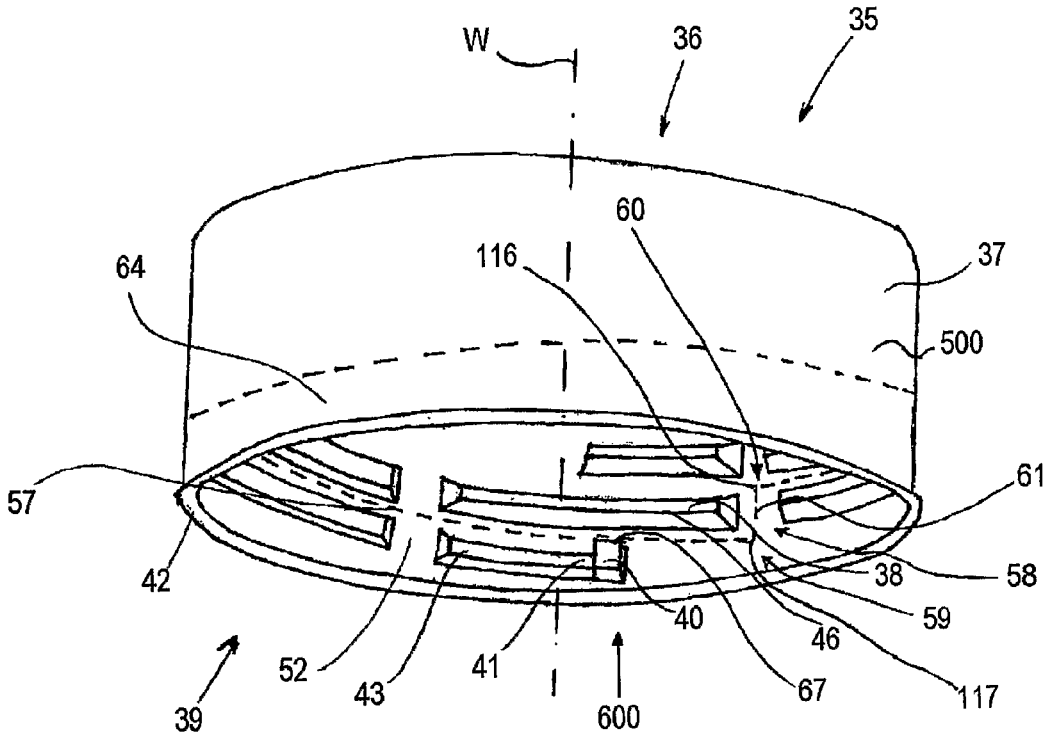
FIG. 16 is a perspective view of a third version of a cap.

FIG. 16 shows a third version of an opening indicating device 39 comprising a third intended separation line arrangement 56 defining a third removable portion 64 destined to be separated from the cylindrical skirt 37 during a first opening of the container.

The third intended separation line arrangement 56 comprises an eighth intended separation line 57 which extends parallel to the thread arrangement 38. In particular, the eighth intended separation line 57 extends from a first zone 59, arranged inferiorly of the thread intermediate portion 46 and close to a further interrupted zone 58, to a second zone 60, arranged superiorly of the thread intermediate portion 46 and close to the further interrupted zone 58, in such a way as to affect the cylindrical skirt 37 substantially over the whole perimeter.

In other words, the eighth intended separation line 57 comprises a first end 116 arranged in the further interrupted zone 58, superiorly of the thread intermediate portion 46, and a second end 117 arranged in the further interrupted zone 58, inferiorly of the thread intermediate portion 46.

The third intended separation line arrangement 56 further comprises a ninth intended separation line 61 which extends along the further interrupted zone 58 transversally to the lower edge 42 and connects the first end 116 and the second end 117 of the eighth intended separation line 57.

Alternatively, the first intended separation line arrangement 44, the second intended separation line arrangement 49 and the third intended separation line arrangement 56 can comprise at least a non-weakened portion, in such a way that the part of the cap 35 which comprises the locking portion 40, and which functions as a tamper-evident ring, does not separate completely from the remaining part of the cap 35 so as to be discarded into the environment.

Figure 17:
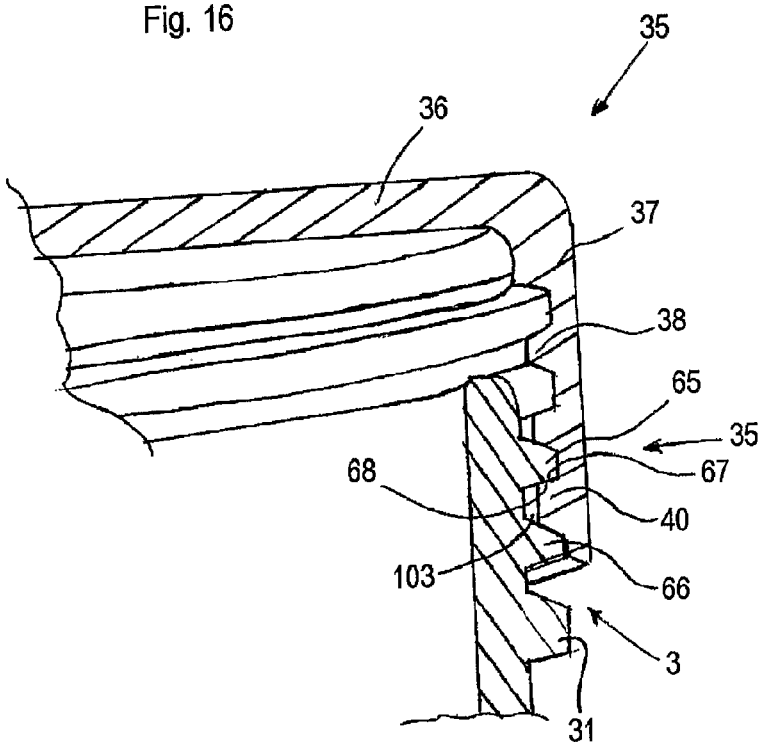
FIG. 17 is a fragmentary axial section showing the cap of one of FIGS. 14 to 16 in an intermediate screwing position on the neck of FIG. 7.

FIG. 17 shows the cap 35 cooperating with the neck 1 in an intermediate screwing-on position on the container. The locking portion 40 has such a dimension so as to be able to advance, while the cap 35 is being screwed onto the neck 1, along cavities interposed between successive helices of the thread arrangement 38. In particular, FIG. 17 shows the locking portion 40 arranged in a cavity 103 defined between a first helix 65 of the thread arrangement 38 and a second helix of the thread arrangement 38.

Figure 18:
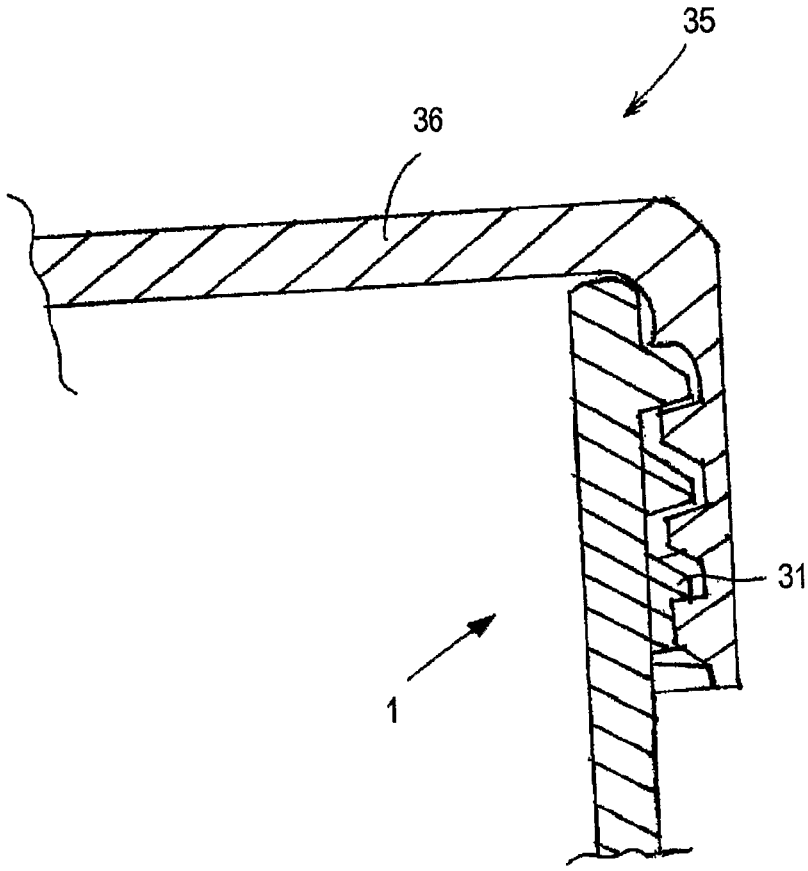
FIG. 18 is a section like the one in FIG. 17 showing the cap of one of FIGS. 14 to 16 in a final locking position on the neck of FIG. 7.
Figure 19:
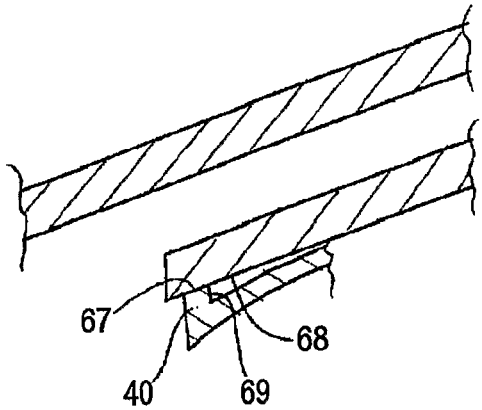
FIG. 19 is a schematic and fragmentary axial section showing a locking device cooperating with a contrast arrangement of the neck in an intermediate screwing configuration on the neck.
Figure 20:
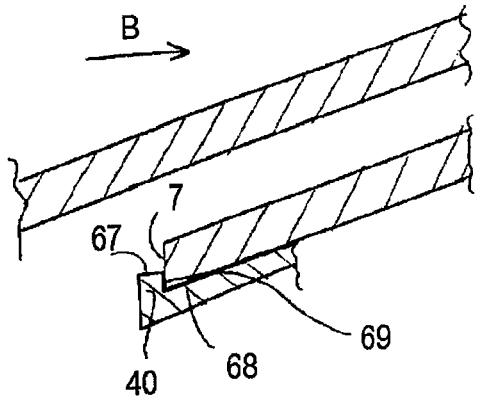
FIG. 20 is a section like the one in FIG. 19 showing the locking device cooperating with the contrast arrangement in a final locking configuration on the neck.

FIG. 18 shows a final screw-on position of the cap 35 on the container. When the cap 35 is screwed on the neck 1, a lower surface 68 of the thread arrangement 38 interacts with an upper surface 67 of the locking portion 40, such as to elastically deform the locking portion 40 so as to move away from the further bottom wall 36, as is schematically shown in FIG. 19. When the cap 35 has been completely screwed on the neck 1, the locking portion 40 is arranged such that the upper surface 67 is disengaged from the lower surface 68, as schematically shown in FIG. 20. The locking portion 40 is then arranged such that a locking surface 69 provided thereon is facing the abutting surface 7. Alternatively, the locking portion 40 can be shaped such that the upper surface 67 does not interact with the thread 3 when the cap 35 is screwed onto the neck 1.

During the first opening of the container, the abutting surface 7 prevents the locking portion 40, which is in the final screw-on position, from moving in an opening direction B. Thus shearing and traction forces are generated, which act along the first intended separation line arrangement 44, or along the second intended separation line arrangement 49, or along the third intended separation line arrangement 56, so that there is a separation either of the first removable portion 62 or the second removable portion 63, or the third removable portion 64, from the cylindrical skirt 37.

The locking surface 69 is arranged transversally to a wall 500 of the cylindrical skirt 37. In particular, the locking surface 39 can lie on a plane passing through a longitudinal axis W of the cap 35 and can be substantially perpendicular to the wall 500, as shown in FIG. 16. Alternatively, the locking surface 39 can lie on an inclined plane with respect to the further longitudinal axis W.

Figure 24:
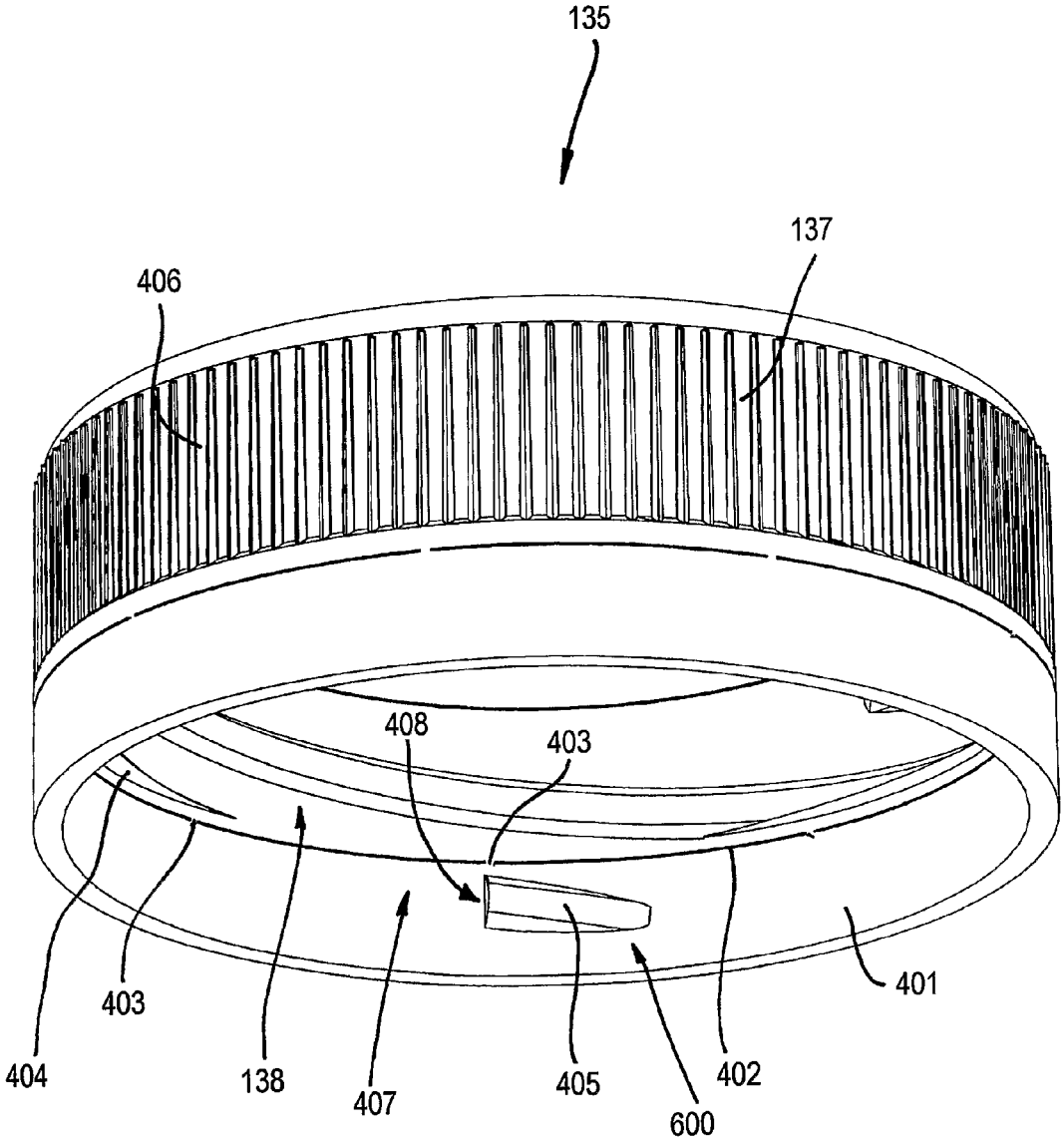
FIG. 24 is a perspective side view of a cap.
Figure 25:
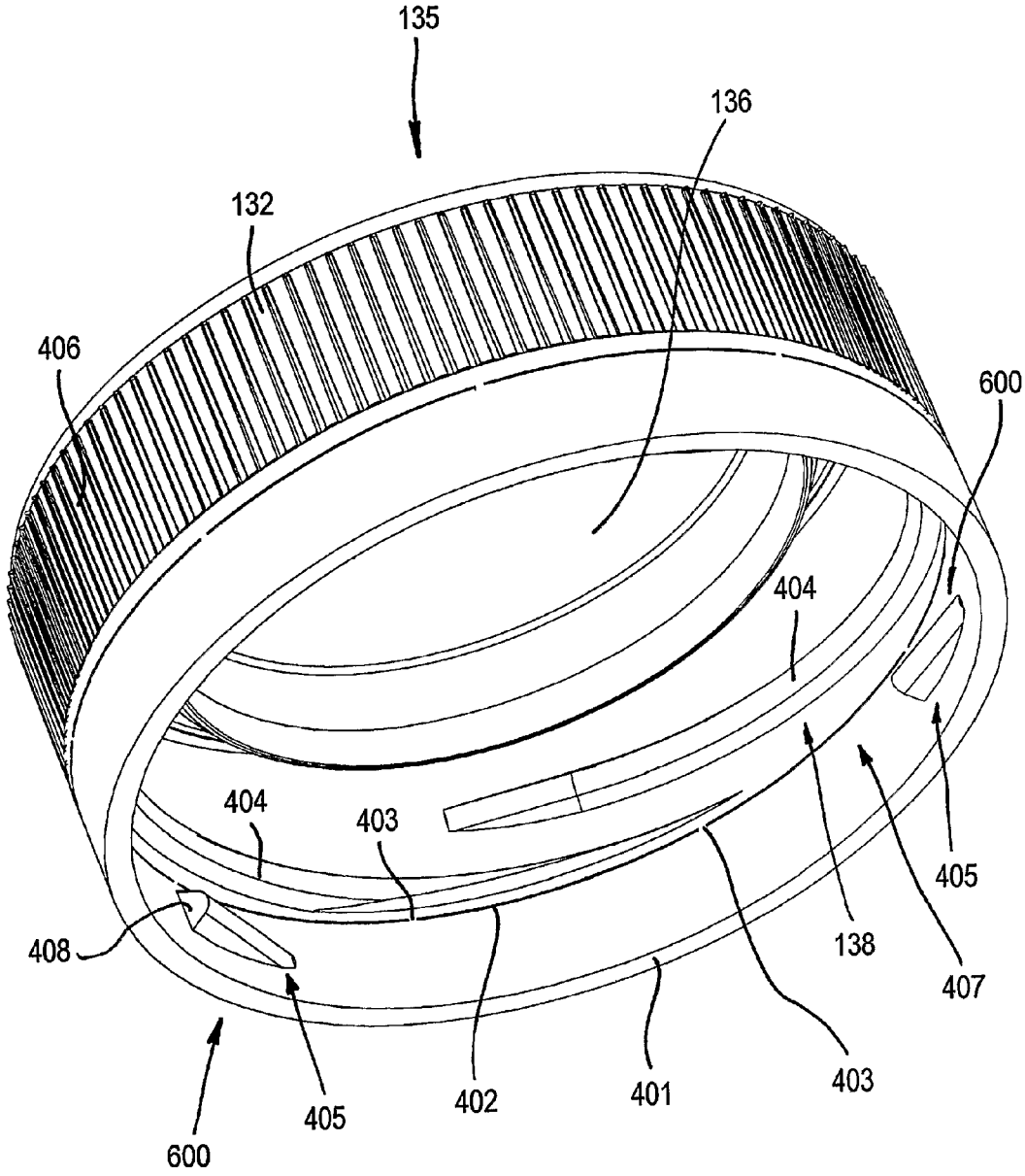
FIG. 25 is a perspective view from below of the cap of FIG. 24.
Figure 26:
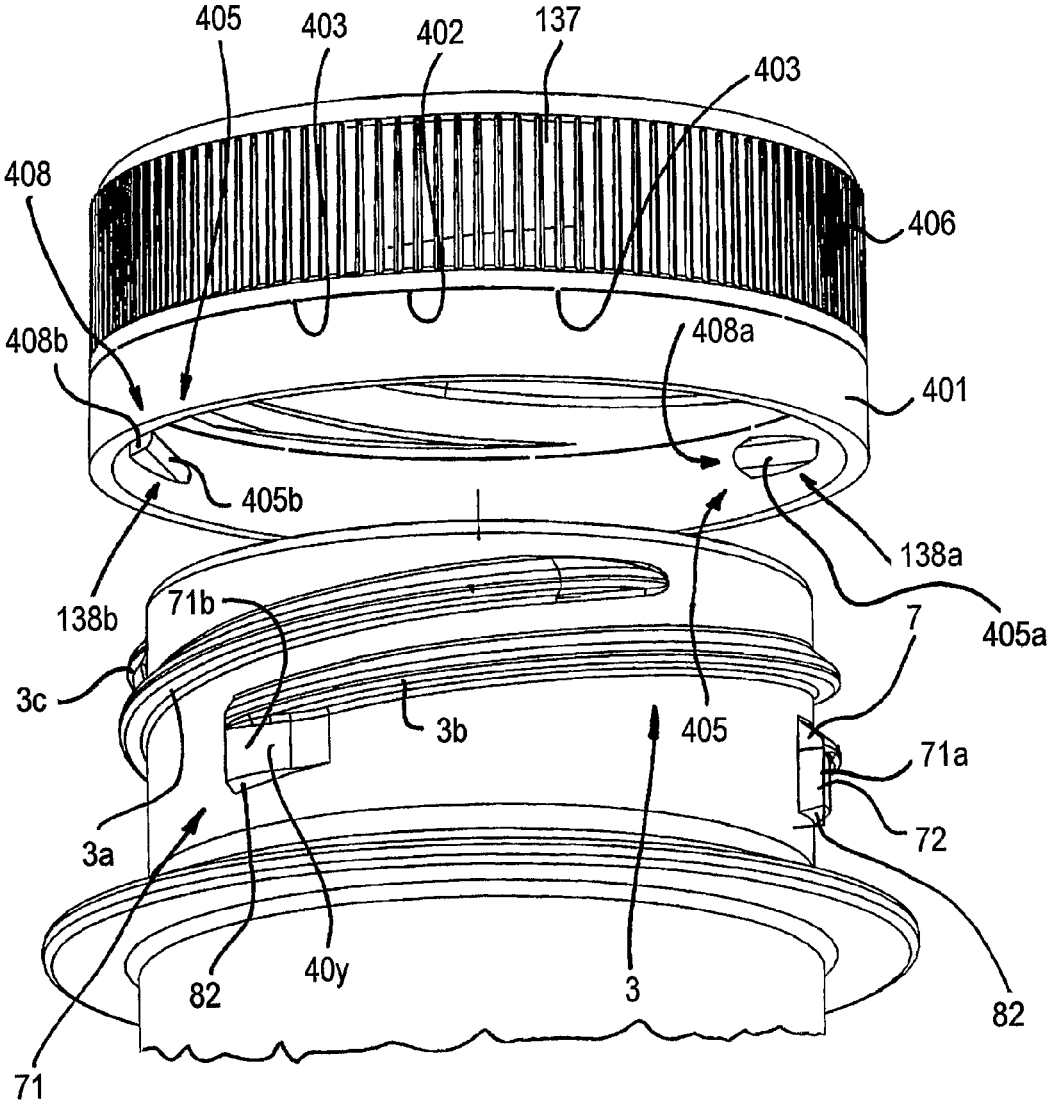
FIG. 26 is a perspective side view of the cap of FIG. 24 and a neck with which the cap are associable.

FIGS. 24 to 26 show a cap 135 comprising a bottom wall 136 from which a cylindrical skirt 137 projects transversally. The bottom wall 136 and the cylindrical skirt 137 define, together, a base body 406 of the cap 135.

A thread arrangement 138 projects from the cylindrical skirt 137 internally of the cap 135.

The cap 135 comprises a tamper-evident band 401. An intended separation line 402 is defined between the tamper-evident band 401 and the cylindrical skirt 137, identified by a plurality of breakable bridge elements 403 which extend between the tamper-evident band 401 and the cylindrical skirt 137. Alternatively, the intended separation line can be defined by weakened portions, for example non-through cuts, or by portions of plastics, continuous or interrupted, having a smaller thickness than the tamper-evident band 401 and the cylindrical skirt 137.

The tamper-evident band 401 comprises a stop arrangement 600 predisposed to promote the breakage of the bridge elements 403 when the cap 135 is removed for the first time from a neck of a container.

The stop arrangement is arranged along a helix arrangement of the thread arrangement 138.

The thread arrangement 138 comprises a first thread portion arrangement 404 and a second thread portion arrangement 405, mutually distinct, a cavity 407 being interposed between the first thread portion arrangement 404 and the second thread portion arrangement 405.

The first thread portion arrangement 404 and the second thread portion arrangement 405 extend along a same helix of the thread arrangement 138.

The first thread portion arrangement 404 extends in the base body 406, in particular in the cylindrical skirt 137.

The second thread portion arrangement 405 extends in the tamper-evident band 401.

The first thread portion arrangement 404 and the second thread portion arrangement 405 are arranged on opposite side of the intended separation line 402, the intended separation line 402 crossing the cavity 407.

The second thread portion arrangement 405 comprises a contrast surface arrangement 408 arranged for interacting with abutting elements associated with a neck of a container in order to promote breakage of the bridge elements 403 when the cap is unscrewed from the neck of the container for the first time.

In the version shown in FIGS. 24 and 25, the stop arrangement 600 comprises the second thread portion arrangement.

In a not-shown version, the stop arrangement can comprise a flap arrangement—or a hook arrangement—provided with a contrast surface arrangement 408 and lying on a helix of the thread arrangement 138 on which the first thread arrangement 404 also lies.

The flap arrangement—or the hook arrangement—has dimensions such as to be received between two consecutive helices of the thread arrangement 138, when the cap 135 is screwed on the neck 1.

FIG. 26 shows how a cap 135 of the type shown in FIGS. 24 and 25 is associable with a neck 1 of the type described with reference to FIGS. 27 to 30. In this case, the thread arrangement 138 comprises a first further thread 138*a*, a second further thread 138*b* and a third further thread, not shown in FIG. 26, which engage with the first thread 3*a*, with the second thread 3*b* and with the third thread 3*c* of the threading 3. The second thread portion arrangement 405 comprises three contrast portions, a first contrast portion 405*a* obtained in the first further thread 138*a*, a second contrast portion 405*b*, obtained in the second further thread 138*b*, and a third contrast portion, not shown in FIG. 26, obtained in the third further thread.

Alternatively, the thread arrangement 138 can comprise a number of threads other than three, in particular the thread arrangement can comprise a single thread.

When the cap 135 is screwed onto the neck 1 for the first time, the second thread portion arrangement 405 is received between consecutive helices of the thread arrangement and screws onto the thread arrangement.

The neck 1 comprises a plurality of contrast elements 71, in particular a first contrast element 71*a*, a second contrast element 71*b* and a third contrast element, not shown in FIG. 26.

The cap 135 is rotated up until when the first contrast portion 405*a* has passed beyond the first contrast element 71*a*, the second contrast portion 405*b* has passed beyond the second contrast element 71*b*, and the third contrast portion has passed beyond the third contrast element.

To enable the second thread portion arrangement 405 to pass the abutting elements 71 more easily, the abutting elements are provided with a curved surface 409 which extends between the external surface 8 and the active surface 72. The abutting elements 71 have a dimension, measured radially with respect to the neck 1, which increases as it proceeds in a direction along which the cap 135 is screwed onto the neck 1.

When the cap 135 is unscrewed from the neck 1 for the first time, the contrast surface arrangement 408 interacts with the active surface 72 of the contrast elements in order to generate a shearing force which causes the fracturing of the bridge elements 403.

In the version shown in FIG. 26, the contrast surface arrangement 408 and the active surfaces 72 are arranged substantially perpendicular with respect to an intended opening direction along which the cap 135 is unscrewed from the neck 1.

In a not-shown version, the active surfaces 72 are inclined with respect to the intended opening direction, in order to define an inclined plane, or a cam profile, which facilitates fracturing of the bridge elements 403, as described with reference to Figures from 27 to 30. In this case, the contrast surface arrangement 408 is also inclined with respect to the intended opening direction, according to the active surfaces 72, in order to engage with the active surfaces 72.

In particular, the contrast surface arrangement 408 comprises a first contrast surface 408*a* obtained in the first contrast portion 405*a* and interacting with the first active surface 72*a*, a second contrast surface 408*b* obtained in the second contrast portion 405*b* and interacting with the second active surface 72*b* and a third contrast surface, not shown in FIGS. 24 and 25, obtained in the third contrast portion interacting with the third active surface.

A cap comprising a stop arrangement 600 provided with a flap arrangement—or a hook arrangement—instead of the second thread portion arrangement 405, interacts with the neck 1, and in particular with the abutting elements 71, in similar ways to the ways described above with reference to the second thread portion arrangement 405.

Figure 31:
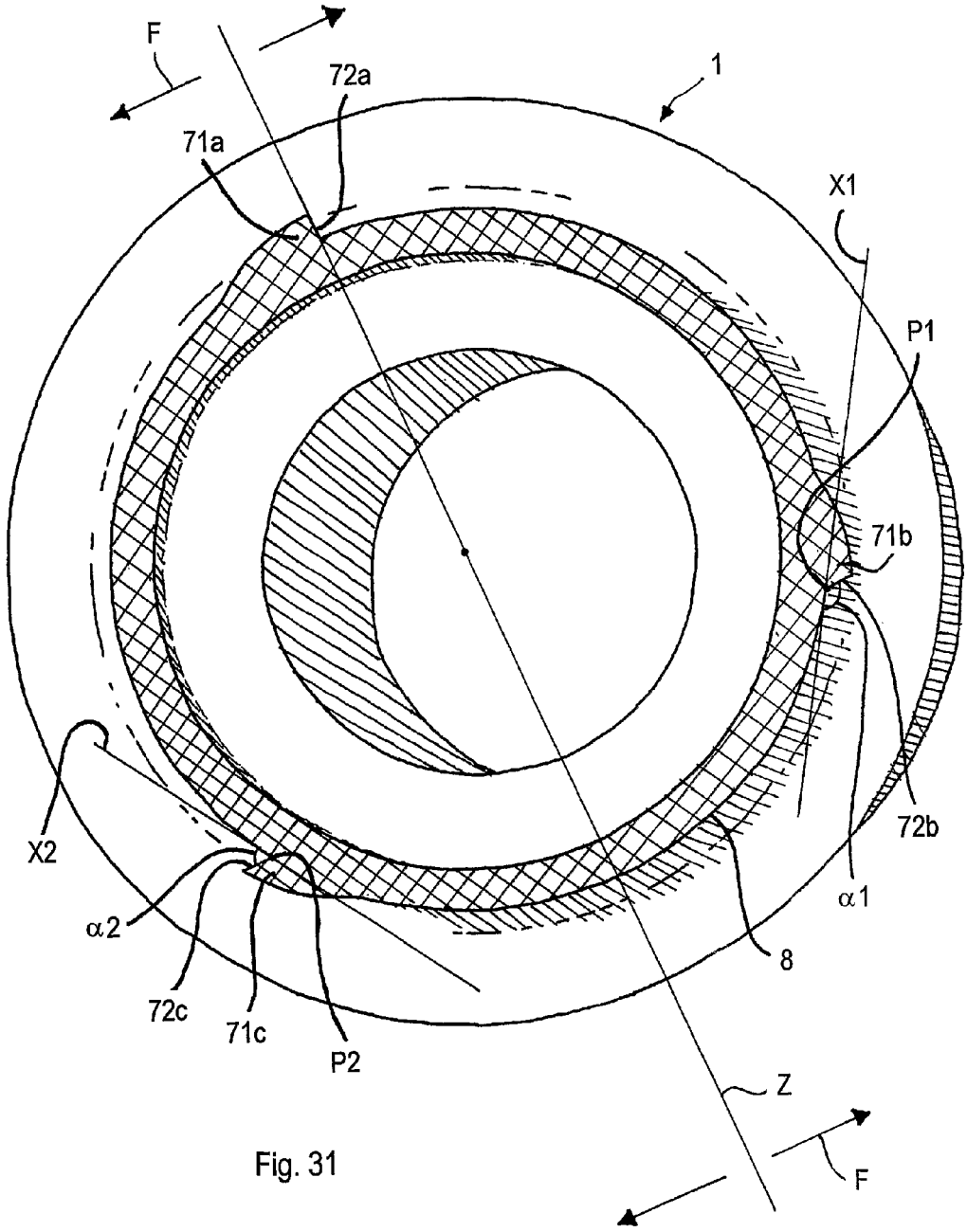
FIG. 31 is a perspective and partially sectioned view from above of a neck showing an abutting arrangement of the neck.

FIG. 31 shows a version of the neck 1 shown in FIGS. 26 to 30.

The neck 1 comprises a first abutting element 71*a*, a second abutting element 71*b* and a third abutting element 71*c*, arranged at angular intervals of substantially 120°.

The first abutting element 71*a* comprises an active surface 72*a* arranged substantially radially with respect to the neck 1.

The second abutting element 71*b* comprises a second active surface 72*b* with forms an obtuse angle □1 with a plane X1 which is tangential to the external surface 8 at a point P1 in which the second active surface 72*b* intersects the external surface 8.

The third abutting element 71*c* comprises a third active surface 72*c* which forms an acute angle □2 with a plane X2 which is tangential to the external surface 8 at a point P2 in which the third active surface 72*c* intersects the external surface 8. The neck 1 shown in FIG. 31 can be obtained using usual moulds comprising a pair of half-moulds which are linearly movable towards and away from one another along the direction F.

When the mould is in a closed forming configuration, the half-moulds are placed in reciprocal contact along a plane Z comprising the first active surface 72*a* and arranged substantially perpendicular to direction F.

As the second active surface 72*b* is inclined at angle □1 and the third active surface 72*c* is inclined at angle □2, the neck 1—and in particular the second abutting element 71*b* and the third abutting element 71*c*—does not comprise undercut portions which would prevent the displacement of the half-moulds along direction F, and consequently would prevent the extract of the neck 1 from the mould.

The invention claimed is:

1. Cap, comprising a base body, a first thread arrangement screwable on a second thread arrangement of a neck of a container, and an opening indicating device provided with a stop arrangement, said stop arrangement being provided along a helix arrangement of said first thread arrangement, said first thread arrangement comprising a first thread portion arrangement and a second thread portion arrangement distinct from said first thread portion arrangement, said stop arrangement comprising said second thread portion arrangement, wherein said opening indicating device comprises a tamper-evident ring, an intended separation line being defined between said tamper-evident ring and said base body, said first thread portion arrangement extending in said base body and said second thread portion arrangement extending in said tamper-evident ring.

2. Cap according to claim 1, wherein said second thread portion arrangement and said first thread portion arrangement extend along a same helix of said helix arrangement.

3. Cap according to claim 1, wherein a cavity is interposed between said first thread portion arrangement and said second thread portion arrangement.

4. Cap according to claim 3, wherein said intended separation line crosses said cavity, said second thread portion arrangement and said first thread portion arrangement being arranged on opposite sides with respect to said intended separation line.

5. Cap according to claim 1, wherein said stop arrangement comprises a counteracting surface arrangement suitable for interacting with an abutting arrangement associated with said neck.

6. Cap according to claim 5, wherein said counteracting surface arrangement is arranged transversally with respect to an intended opening direction along which said cap is unscrewed from said neck.

7. Cap according to claim 1, wherein said stop arrangement comprises a plurality of stop elements distinct from one another.

8. Cap according to claim 7, wherein said stop arrangement comprises a counteracting surface arrangement suitable for interacting with an abutting arrangement associated with said neck, said counteracting surface arrangement comprising a plurality of counteracting surfaces distinct from one another, each stop element of said plurality of stop elements comprising a corresponding counteracting surface of said plurality of counteracting surfaces.

9. Cap according to claim 1, wherein said first thread arrangement comprises a plurality of threads distinct from one another and said second thread portion arrangement comprises a plurality of threaded end portions distinct from one another, each thread of said plurality of threads comprising a corresponding threaded end portion of said plurality of threaded end portions.

10. Closure arrangement, comprising a cap provided with a base body, with a first thread arrangement and with an opening indicating device comprising a stop arrangement, said closure arrangement further comprising a neck of a container provided with a second thread arrangement, said first thread arrangement being screwable on said second thread arrangement, said stop arrangement being provided along a helix arrangement of said first thread arrangement and interacting with an abutting arrangement projecting from said neck, said first thread arrangement comprising a first thread portion arrangement and a second thread portion arrangement distinct from said first thread portion arrangement, said stop arrangement comprising said second thread portion arrangement, wherein said opening indicating device comprises a tamper-evident ring, an intended separation line being defined between said tamper-evident ring and said base body, said first thread portion arrangement extending in said base body and said second thread portion arrangement extending in said tamper-evident ring.

11. Closure arrangement according to claim 10, wherein said second thread portion arrangement and said first thread portion arrangement extend along a same helix of said helix arrangement.

12. Closure arrangement according to claim 10, wherein a cavity is interposed between said first thread portion arrangement and said second thread portion arrangement.

13. Closure arrangement according to claim 12, wherein said intended separation line crosses said cavity, said second thread portion arrangement and said first thread portion arrangement being arranged on opposite sides with respect to said intended separation line.

14. Closure arrangement according to claim 10, wherein said stop arrangement comprises a counteracting surface arrangement arranged for interacting with said abutting arrangement.

15. Closure arrangement according to claim 14, wherein said counteracting surface arrangement is arranged transversally with respect to an intended opening direction along which said cap is unscrewed from said neck.

16. Closure arrangement according to claim 10, wherein said stop arrangement comprises a plurality of stop elements distinct from one another.

17. Closure arrangement according to claim 16, wherein said stop arrangement comprises a counteracting surface arrangement arranged for interacting with said abutting arrangement, said counteracting surface arrangement comprising a plurality of counteracting surfaces distinct from one another, each stop element of said plurality of stop elements comprising a corresponding counteracting surface of said plurality of counteracting surfaces.

18. Closure arrangement according to claim 10, wherein said first thread arrangement comprises a plurality of threads distinct from one another and said second thread portion arrangement comprises a plurality of threaded end portions distinct from one another, each thread of said plurality of threads comprising a corresponding threaded end portion of said plurality of threaded end portions.

19. Closure arrangement according to claim 10, wherein said abutting arrangement extends circumferentially from said neck.

20. Closure arrangement according to claim 10, wherein said abutting arrangement is further from an opening of said neck than said second thread arrangement.

21. Closure arrangement according to claim 20, wherein said abutting arrangement extends from said first thread arrangement at an opposite side with respect to said opening.

22. Closure arrangement according to claim 14, wherein said abutting arrangement comprises an active surface arrangement arranged for interacting with said counteracting surface arrangement.

23. Closure arrangement according to claim 22, wherein said active surface arrangement and said counteracting surface arrangement are so shaped as to generate a shearing stress which promotes breakage of bridge elements of said opening indicating device, when said cap is unscrewed from said neck.

24. Closure arrangement according to claim 22, wherein said abutting arrangement comprises a further active surface arrangement arranged transversally with respect to said active surface arrangement.

25. Closure arrangement according to claim 24, wherein said further active surface arrangement is so shaped as to generate a tensile stress which promotes breakage of bridge elements of said opening indicating device, when said cap is unscrewed from said neck.

26. Closure arrangement according to claim 10, wherein said second thread arrangement comprises end portions provided with a face arrangement arranged transversally with respect to an intended opening direction along which said cap is unscrewed from said neck.

27. Closure arrangement according to claim 26, wherein said stop arrangement comprises a counteracting surface arrangement arranged for interacting with said abutting arrangement, said abutting arrangement comprises an active surface arrangement arranged for interacting with said counteracting surface arrangement and said active surface arrangement and said face arrangement are substantially coplanar.

28. Closure arrangement according to claim 10, wherein said abutting arrangement comprises a plurality of abutting elements distinct from one another.

29. Closure arrangement according to claim 28, wherein said stop arrangement comprises a counteracting surface arrangement arranged for interacting with said abutting arrangement, said abutting arrangement comprises an active surface arrangement arranged for interacting with said counteracting surface arrangement and said active surface arrangement comprises a plurality of active surfaces distinct from one another, each abutting element of said plurality of abutting elements comprising a corresponding active surface of said plurality of active surfaces.

30. Closure arrangement according to claim 28, wherein said stop arrangement comprises a counteracting surface arrangement arranged for interacting with said abutting arrangement, said abutting arrangement comprises an active surface arrangement arranged for interacting with said counteracting surface arrangement, said abutting arrangement comprises a further active surface arrangement arranged transversally with respect to said active surface arrangement and said further active surface arrangement comprises a plurality of further active surfaces distinct from one another, each abutting element of said plurality of abutting elements comprising a corresponding further active surface of said plurality of further active surfaces.

31. Closure arrangement according to claim 28, wherein said abutting elements lie substantially on a same plane.

32. Closure arrangement according to claim 28, wherein said second thread arrangement comprises a plurality of further threads, each abutting element of said plurality of abutting elements being associated with a corresponding further thread of said plurality of further threads.

* * * * *